US011280488B2

(12) United States Patent
Niwa

(10) Patent No.: US 11,280,488 B2
(45) Date of Patent: Mar. 22, 2022

(54) ELECTRIC WORKING MACHINE, ILLUMINATOR ATTACHMENT, AND METHOD OF RADIATING LIGHT FROM ELECTRIC WORKING MACHINE

(71) Applicant: MAKITA CORPORATION, Anjo (JP)

(72) Inventor: Akira Niwa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/154,090

(22) Filed: Jan. 21, 2021

(65) Prior Publication Data

US 2021/0222866 A1 Jul. 22, 2021

(30) Foreign Application Priority Data

Jan. 20, 2020 (JP) ..... JP2020-006725
Nov. 16, 2020 (JP) ..... JP2020-190254

(51) Int. Cl.
*F21V 33/00* (2006.01)
*B25B 21/00* (2006.01)
*F21V 13/04* (2006.01)

(52) U.S. Cl.
CPC ..... *F21V 33/008* (2013.01); *B25B 21/00* (2013.01); *F21V 13/045* (2013.01); *F21V 2200/15* (2015.01); *F21V 2200/20* (2015.01)

(58) Field of Classification Search
CPC .. F21V 33/008; F21V 13/045; F21V 2200/15; F21V 2200/20; B25B 21/00
See application file for complete search history.

(56) References Cited

FOREIGN PATENT DOCUMENTS

| | | | |
|---|---|---|---|
| CN | 207290007 U | * | 5/2018 |
| JP | 2019-111612 A | | 7/2019 |
| WO | 2019/124444 A1 | | 6/2019 |

OTHER PUBLICATIONS

CN207290007U English translation (Year: 2018).*

* cited by examiner

*Primary Examiner* — Anne M Hines
(74) *Attorney, Agent, or Firm* — Oliff PLC

(57) ABSTRACT

An electric working machine according to one aspect of the present disclosure includes a motor, a driving mechanism, a housing, a grip, a first light emitter, and a light guide. The first light emitter emits light. The light guide has a ring-shape. The light guide is extending along an outer circumference of the housing. The light guide includes a light entering surface receiving the light emitted from the first light emitter. While propagating the light entered from the light entering surface in the light guide, the light guide radiates the light from a surface of the light guide.

29 Claims, 21 Drawing Sheets

ELECTRIC WORKING MACHINE, ILLUMINATOR ATTACHMENT, AND METHOD OF RADIATING LIGHT FROM ELECTRIC WORKING MACHINE

CROSS-REFERENCE TO RELATED APPLICATIONS

This application claims the benefit of Japanese Patent Application No. 2020-006725 filed on Jan. 20, 2020 and Japanese Patent Application No. 2020-190254 filed on Nov. 16, 2020 with the Japan Patent Office, the entire disclosures of which are incorporated herein by reference.

BACKGROUND

The present disclosure relates to an electric working machine.

Japanese Unexamined Patent Application Publication No. 2019-111612 discloses an impact tool having two light emitting diodes (LEDs) to illuminate a working point.

SUMMARY

LEDs generally have light directionality. Thus, the aforementioned impact tool is capable of locally illuminating the working point, but is less capable of illuminating an area other than the working point. If the impact tool is capable of illuminating not only the working point but also a wider area surrounding the working point, the workability of the impact tool is expected to be further improved.

In one aspect of the present disclosure, it is preferable to provide an electric working machine capable of widely illuminating a working point.

An electric working machine according to one aspect of the present disclosure includes a motor, a driving mechanism, a housing, a grip, a first light emitter, and/or a light guide. The driving mechanism transmits rotational force of the motor to a tool. The housing accommodates the motor and the driving mechanism. The grip is held (or gripped) by a user of the electric working machine. The first light emitter emits light. The light guide has a ring-shape. The light guide extends along an outer circumference of the housing. The light guide includes a light entering surface. The light entering surface receives the light emitted from the first light emitter. While propagating the light entered the light entering surface in the light guide, the light guide radiates the light from a surface of the light guide.

In this electric working machine, the light emitted from the first light emitter is radiated to a surrounding area of the electric working machine via the light guide. In other words, the light is radiated from a surface of the annular light guide toward the surrounding area of the electric working machine. Thus, the electric working machine can suitably illuminate its surrounding area and improves its workability. It is possible to provide an electric working machine capable of more widely illuminating the working point.

The electric working machine may further include a reflector. The reflector reflects the light radiated in a first direction from the light guide toward a second direction opposite the first direction.

In this electric working machine, the light radiated in the first direction from the light guide is guided in the second direction by the reflector. This increases a light quantity radiated in the second direction, and thus it is possible to illuminate the second direction more brightly.

The light guide may have a center axis. The first direction and the second direction may intersect with a first virtual plane. The first virtual plane may be orthogonal to the center axis. The center axis is, for example, an axis passing through the center of a circle surrounded by a central curve in the annular light guide. The center axis is orthogonal to the circle.

In this electric working machine, the light reflected by the reflector is not radiated in a direction parallel to the first virtual plane. The light reflected by the reflector is radiated in a direction intersecting with the first virtual plane. Thus, the light radiated from the light guide can be effectively guided in the second direction.

The reflector may include an annular member having a ring-shape. The light guide may be arranged so as to face the annular member.

In this electric working machine, more light radiated in the first direction from the light guide can be reflected in the second direction. Thus, the light radiated from the light guide can be effectively guided in the second direction.

The annular member may include a groove. In the annular member, the groove may be arranged along a circumferential direction of the annular member. The light guide may be fitted into the groove.

In this electric working machine, the reflector is easily positioned with respect to the light guide. Thus, it is possible to easily assemble the light guide and reflector to the electric working machine.

The electric working machine may further include a cover. The cover may have a ring-shape. The cover may have a light transmittance of more than zero. The light transmittance corresponds to, for example, a ratio of the intensity of light passed through the cover to the intensity of light entered the cover. The cover may be detachably attached to the reflector. The cover may be attached to the reflector so as to cover the light guide over a circumferential direction of the light guide.

In this electric working machine, it is possible to suitably define a positional relationship between the light guide and the reflector. In addition, the cover can protect the light guide.

The first light emitter may be provided to the reflector. In this electric working machine, the reflector may have two functions. The first function may be a function to reflect the light from the light guide. The second function may be a function to mount the first light emitter. With this configuration, it is not necessary to provide a member other than the reflector to fix the first light emitter. This may realize reduction in size and manufacturing man-hours of the electric working machine.

The reflector may be integrally molded with an insulating material. In this electric working machine, the reflector can be easily manufactured.

The insulating material may be any material having an insulation property. The insulating material may contain or does not necessarily contain, for example, a resin. The resin may be, for example, thermoplastic resin or thermosetting resin. The insulating material may contain or does not necessarily contain, for example, a glass. The insulating material may contain or does not necessarily contain, for example, rubber.

The reflector may be integrally molded by any method. The reflector may be integrally molded by, for example, injection molding or by low temperature and pressure molding. The injection molding is a method in which thermally molten insulating material is injected into a metal mold and then the insulating material is cured, thereby integrally forming a part. The low temperature and pressure molding is also called hotmelt molding.

The reflector provided with the first light emitter may include a first conductor trace (or a first printed wiring or a first patterned conductor). The first conductor trace may be integrally provided to a surface of the reflector. The first conductor trace may be electrically coupled to the first light emitter.

In this electric working machine, the reflector may further have a third function in addition to the above-described first and second functions. The third function may be a function to electrically couple the first light emitter to a circuit distinct from that of the first light emitter. This may achieve further reduction in size and manufacturing man-hours (especially reduction in man-hours of wiring operation) of the electric working machine.

The electric working machine may further include a second light emitter configured to emit additional light.

In this electric working machine, the electric working machine illuminates the surrounding area thereof by the light from the light guide and the additional light from the second light emitter. Thus, it is possible to more brightly illuminate the surrounding area of the electric working machine. Thus, the workability of the electric working machine may further improve.

The second light emitter may be provided to the reflector. In this electric working machine, the reflector may have the first function and a fourth function. The fourth function may be a function to mount the second light emitter. With this configuration, it is not necessary to provide a member other than the reflector to fix the second light emitter. This realizes reduction in size and manufacturing man-hours of the electric working machine.

The reflector may include a second conductor trace (or a second printed wiring or a second patterned conductor). The second conductor trace may be provided to a surface of the reflector. The second conductor trace may be electrically coupled to the second light emitter.

In this electric working machine, the reflector may further have a fifth function. The fifth function may be a function to electrically couple the second light emitter to a circuit distinct from that of the second light emitter. This may achieve further reduction in size and manufacturing man-hours (especially reduction in man-hours of wiring operation) of the electric working machine.

An optical axis of the additional light may intersect with the center axis of the light guide. In this electric working machine, this intersecting region in the center axis of the light guide is illuminated by the additional light from the second light emitter. Thus, the intersecting region is more brightly illuminated by the light from the light guide and the additional light from the second light emitter.

The electric working machine may further includes an engaged portion. The reflector may include an engaging portion engaged with the engaged portion. The reflector may be detachably attached to the electric working machine by the engaging portion engaged with the engaged portion.

In this electric working machine, the reflector is easily attached. In addition, the reflector is easily removed as needed.

The first light emitter may be provided to the housing. The electric working machine may further include an illuminator attachment including the light guide. The illuminator attachment may have a ring-shape. The illuminator attachment may be configured to be detachably attached to the housing.

In this electric working machine, a user can easily attach/remove the illuminator attachment to/from the electric working machine. Thus, the user can work with the illuminator attachment, whereas the user can work without the illuminator attachment.

The illuminator attachment may include at least one support. The at least one support may include a supporting surface. The supporting surface may be configured to come in contact with a surface of the housing.

In such electric working machine, the illuminator attachment is supported on the housing via the at least one support.

The at least one support may be pressed from the surface of the housing in response to the illuminator attachment arranged at a specified position. The at least one support may be elastically deformed by being pressed from the surface of the housing. The illuminator attachment arranged at the specified position may be attached to the housing by biasing force applied to the surface of the housing from the at least one support elastically deformed.

In this electric working machine, a user can easily attach/remove the illuminator attachment to/from the electric working machine.

The at least one support may include two or more supports. The two or more supports may be arranged to be separated from each other along a circumferential direction of the illuminator attachment.

In this electric working machine, it is possible to make the illuminator attachment hardly come off from the electric working machine.

The electric working machine may further include an attachment auxiliary part. The attachment auxiliary part may be detachably attached to the housing. The illuminator attachment may be detachably attached to the attachment auxiliary part.

In this electric working machine, the illuminator attachment can be attached to the electric working machine via the attachment auxiliary part.

The light guide may have a center axis, and the light entering surface may be arranged so that a second virtual plane parallel to the light entering surface intersects with the center axis of the light guide. The second virtual plane may intersect with the center axis of the light guide at any angle. The second virtual plane may be orthogonal to the center axis of the light guide.

In this electric working machine, the first light emitter can be arranged between the electric working machine and the light guide. Thus, it is possible to inhibit the light from the first light emitter from directly radiated outside the electric working machine without going through the light guide.

The light guide may propagate the light entered the light entering surface in a first circumferential direction and a second circumferential direction of the light guide. The second circumferential direction is opposite the first circumferential direction.

In this electric working machine, the light from the first light emitter propagates inside the light guide over a whole or nearly whole circumference of the light guide. This allows the electric working machine to radiate light from a whole or nearly whole range of the surface of the light guide except for the light entering surface. Thus, it is possible to effectively and more brightly illuminate the surrounding area of the electric working machine.

The first light emitter may include any light source that emits light. The first light emitter may include, for example, a light emitting diode.

Another aspect of the present disclosure is to provide an illuminator attachment. The illuminator attachment is detachably attached to an electric working machine. The electric working machine includes a motor, a housing, a grip, and/or a light emitter. The housing accommodates the motor. The grip is held by a user of the electric working machine. The light emitter emits light.

The illuminator attachment includes a light guide and/or a support. The light guide has a ring-shape. The light guide is arranged so as to surround an outer circumference of the housing in response to the illuminator attachment attached to the electric working machine. The light guide includes a light entering surface. The light entering surface receives the light emitted from the light emitter. While propagating the light entered the light entering surface in the light guide, the light guide radiates the light from a surface of the light guide The support supports the illuminator attachment on the electric working machine.

By attaching this illuminator attachment to the electric working machine, it is possible to radiate the light emitted from the light emitter to a wider area.

Still another aspect of the present disclosure is to provide a method of radiating light from an electric working machine. The method includes emitting light from a light emitter provided in the electric working machine, receiving the light emitted from the light emitter into a light guide, the light guide having a ring-shape, propagating the light entered the light guide in the light guide along a circumferential direction of the light guide, and radiating the light propagating in the light guide from a surface of the light guide. With this method, it is possible to radiate the light emitted from the light emitter to a wider area.

BRIEF DESCRIPTION OF THE DRAWINGS

Some example embodiments of the present disclosure will be described hereinafter by way of example with reference to the accompanying drawings, in which.

DETAILED DESCRIPTION OF EXAMPLE EMBODIMENTS

[1. First Embodiment]

(1-1) Configuration of Electric Working Machine

Figure 1:
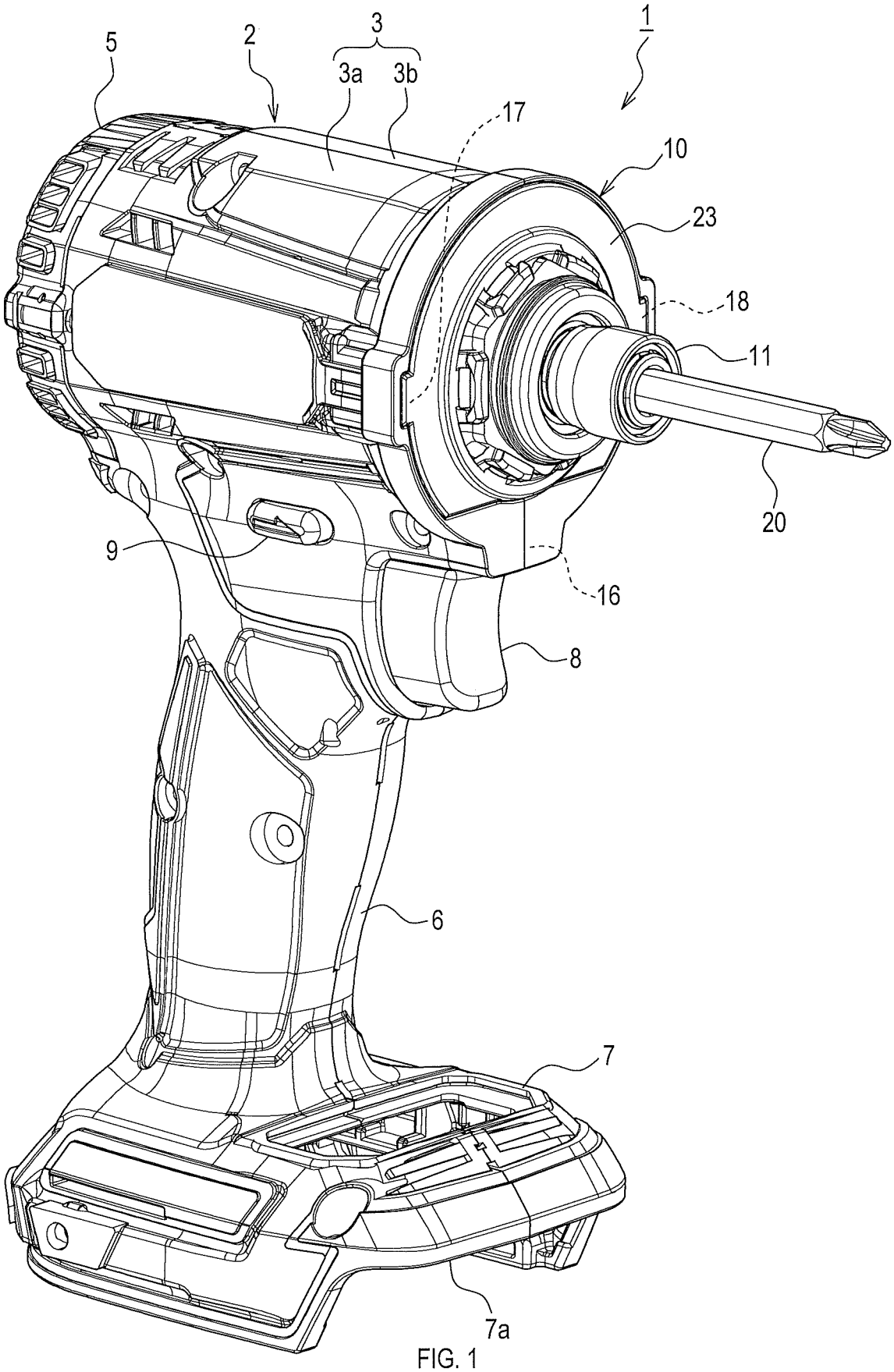
FIG. 1 is a front perspective view of an electric working machine of a first embodiment.
Figure 2:
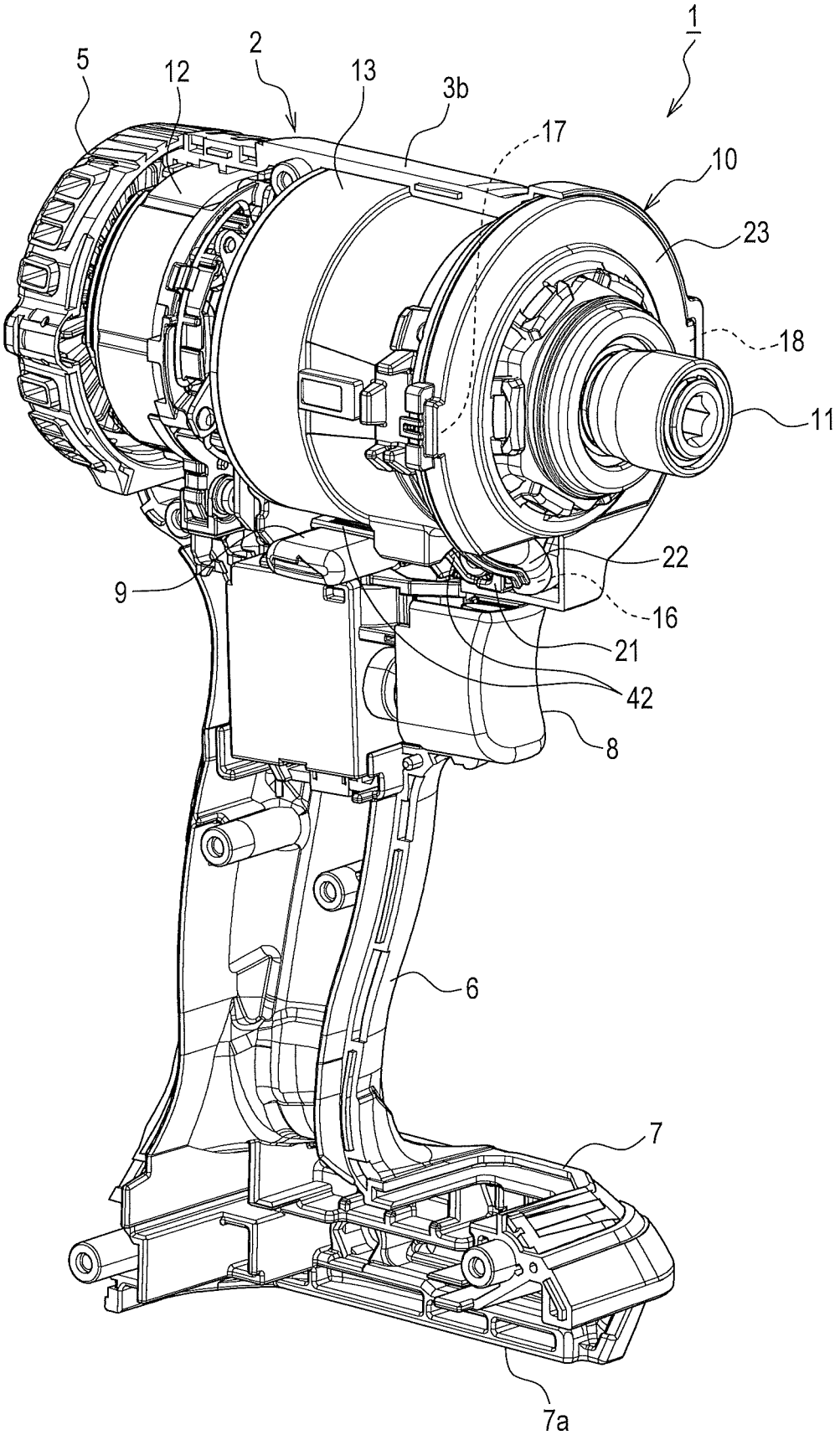
FIG. 2 is a front perspective view of the electric working machine of the first embodiment, with a first half housing removed.

As shown in FIG. 1 and FIG. 2, an electric working machine 1 of a first embodiment is, for example, formed as a rechargeable impact driver. The rechargeable impact driver may be used, for example, to rotate fastening parts, such as a screw and a bolt. The rechargeable impact driver may generate a large torque in a rotation direction by hammering in the rotation direction in accordance with a load incurred during the rotation of the fastening part. The electric working machine 1 of the first embodiment is driven, for example, by electric power supplied from a below-described battery pack 100 (see FIG. 4).

As shown in FIG. 1 and FIG. 2, the electric working machine 1 of the first embodiment includes a main body 2. The main body 2 includes a housing 3. The housing 3 includes a first half housing 3*a* and a second half housing 3*b* that are divided into right and left parts. The first half housing 3*a* and the second half housing 3*b* are combined to form the housing 3. The housing 3 may be, for example, an injection molded member containing a resin. FIG. 2 shows the electric working machine 1 with the first half housing 3*a* removed.

The main body 2 includes a first storage 5, a grip 6, and a second storage 7. The first storage 5 contains a motor 12 (FIG. 2) and a driving mechanism 13 (FIG. 2). The first storage 5 further includes a rotation direction selector 9, a light unit 10, and a chuck sleeve 11.

The chuck sleeve 11 detachably receives a tool selected from various tools. The various tools may include, for example, a plus driver bit 20 shown in FIG. 1. The various tools may have a length equal to each other. In the first embodiment, the tools may have two or more lengths. In the first embodiment, the shortest tool may be, for example, about 50 mm in length, and the longest tool may be, for example, about 150 mm in length.

The motor 12 is, for example, a brushless motor in the first embodiment. The motor 12 generates a rotational driving force (rotational force) and the rotational driving force is transmitted to the driving mechanism 13. The driving mechanism 13 includes, for example, a deceleration mechanism (not shown) and a hammering mechanism (not shown). The deceleration mechanism transmits the rotational driving force of the motor 12 to the hammering mechanism while reducing a rotational speed of the motor 12.

The hammering mechanism may include a spindle (not shown), a hammer (not shown) and an anvil (not shown).

The spindle is rotated by the rotational driving force of the motor 12 transmitted via the deceleration mechanism. The hammer is rotated together with the spindle in response to the rotation of the spindle. The hammer is further movable in a direction parallel to a rotation axis of the chuck sleeve 11. The anvil has the chuck sleeve 11 attached thereto.

In the hammering mechanism, the spindle is rotated in response to the rotation of the motor 12, and the anvil is rotated via the hammer. In response to the rotation of the anvil, the chuck sleeve 11 (i.e. a tool attached to the chuck sleeve 11) is rotated. In response to work using the tool (e.g. screwing a screw to a target object) proceeding and the load imposed on the anvil exceeding a specified level, the hammer gives an impact to the anvil. This impact is added in a rotation direction of the chuck sleeve 11. This impact increases the rotational torque of the chuck sleeve 11.

The rotation direction selector 9 is operated to select and set a rotation direction of the motor 12 (i.e. the rotation direction of the chuck sleeve 11) in a first rotation direction or in a second rotation direction.

The grip 6 extends from the first storage 5. The grip 6 is held (or gripped) by, for example, a user of the electric working machine 1. The grip 6 includes a trigger 8. The user can operate (e.g. pull) the trigger 8 while holding the grip 6. Pulling the trigger 8 corresponds to moving the trigger 8 in a left direction in FIG. 2 (or, pushing the trigger 8 into the main body 2) in the first embodiment.

Figure 4:
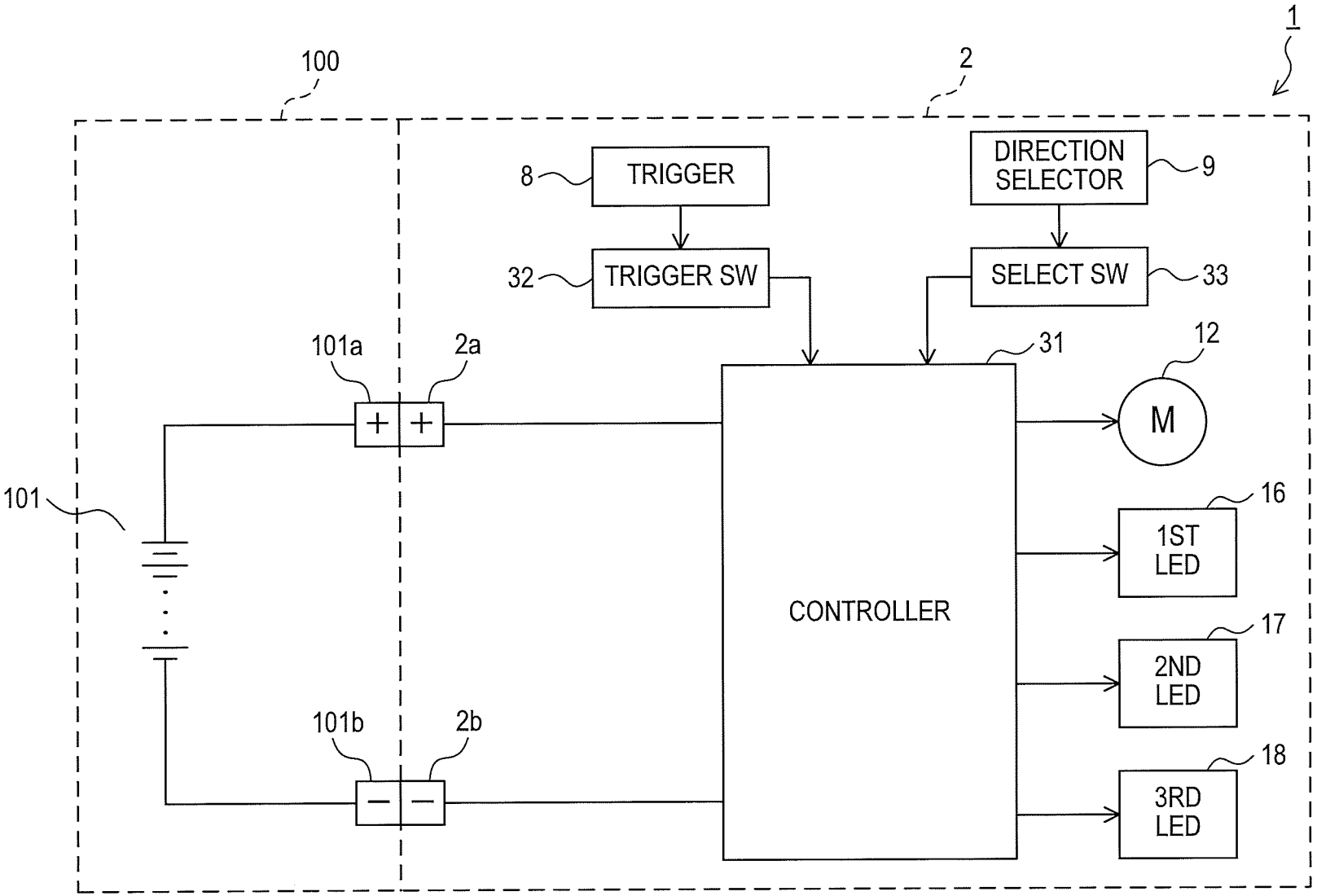
FIG. 4 is a diagram showing an electrical configuration of the electric working machine of the first embodiment.

The second storage 7 extends from the grip 6. The second storage 7 includes a battery attachment portion 7*a*. The battery attachment portion 7*a* receives a battery pack 100 that is detachably attached. The second storage 7 further houses a below-described controller 31 (FIG. 4).

The light unit 10 emits light on a surrounding area (outside) of the electric working machine 1 to illuminate the surrounding area of the electric working machine 1. For example, the light unit 10 emits more light in a front direction of the electric working machine 1, thereby illuminating the front direction of the electric working machine 1. In the first embodiment, "front direction" means a direction that is parallel to the rotation axis of the motor 12 and that is directed from the motor 12 toward the driving mechanism 13. In the first embodiment, "rear direction" means a direction opposite the front direction. In the first embodiment, the rotation axis of the motor 12 coincides with the rotation axis of the chuck sleeve 11 (i.e. the rotation axis of the tool). Thus, hereinafter, each of the rotation axis of the motor 12 and the rotation axis of the chuck sleeve 11 is simply referred to as "rotation axis".

Figure 3:
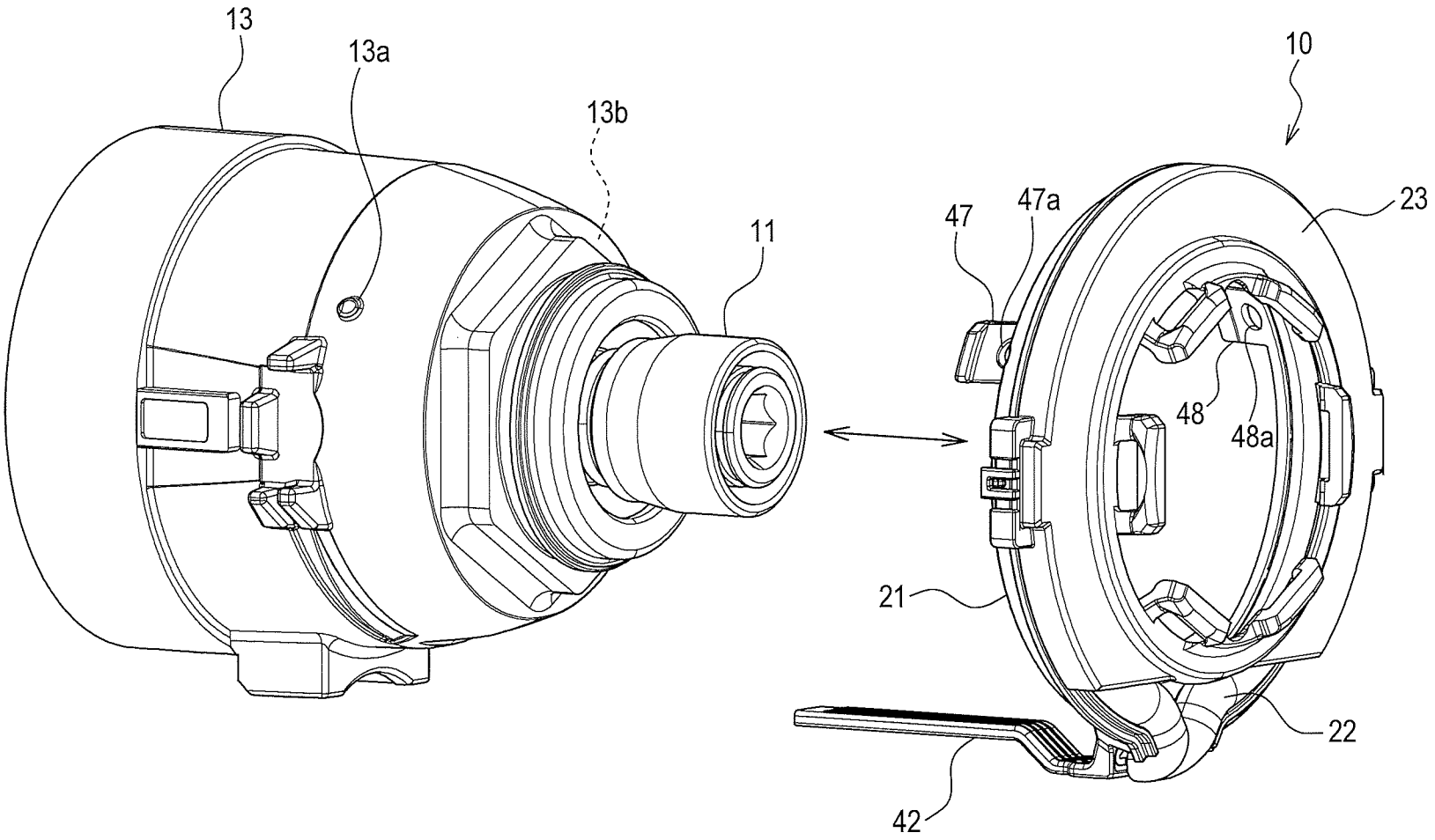
FIG. 3 is a front perspective view of a driving mechanism and a light unit of the first embodiment.

As shown in FIG. 1 to FIG. 3, the light unit 10 has a ring-shape. The light unit 10 includes an opening. As shown in FIG. 1 and FIG. 2, the light unit 10 is arranged along an outer circumference of the housing 3. Specifically, in the first embodiment, the light unit 10 is arranged along an outer circumference of the first storage 5. More specifically, the light unit 10 extends (or is arranged) so as to surround a first end of the first storage 5. Still more specifically, the light unit 10 is arranged so as to surround a first end of the driving mechanism 13. In other words, the leading end portion of the first storage 5 and the chuck sleeve 11 pass through the opening of the light unit 10.

The light unit 10 includes a first LED 16. The light unit 10 further includes a second LED 17 and a third LED 18. As shown in FIG. 2, the light unit 10 further includes a light guide 22. The light unit 10 further includes a reflector 21. The light unit 10 further includes a cover 23. The reflector 21 includes a wiring bar 42 in the first embodiment. The first to third LEDs 16-18 each emit light.

Figure 5:
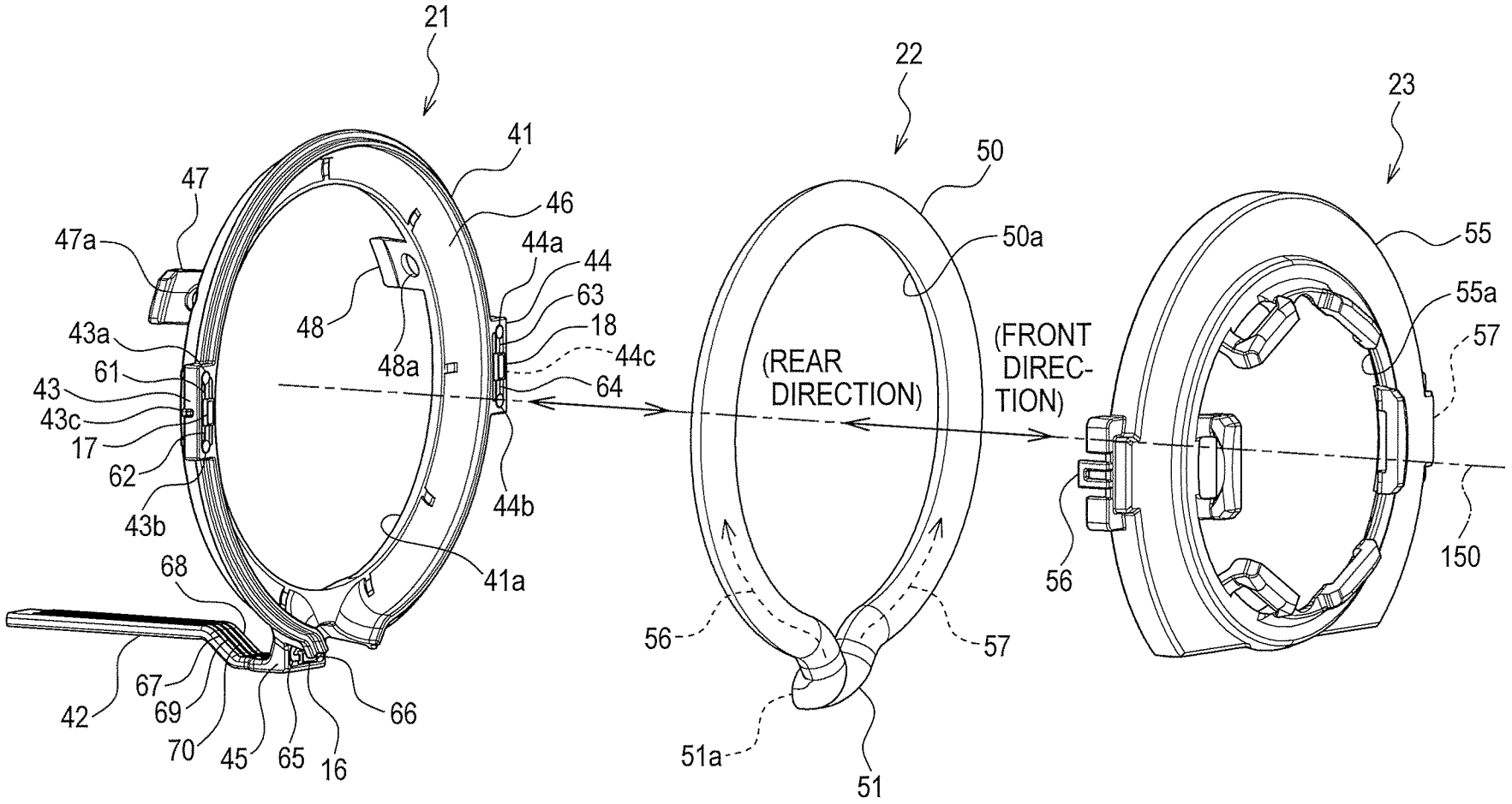
FIG. 5 shows front perspective views of a light guide, a reflector and a cover of the first embodiment.
Figure 6:
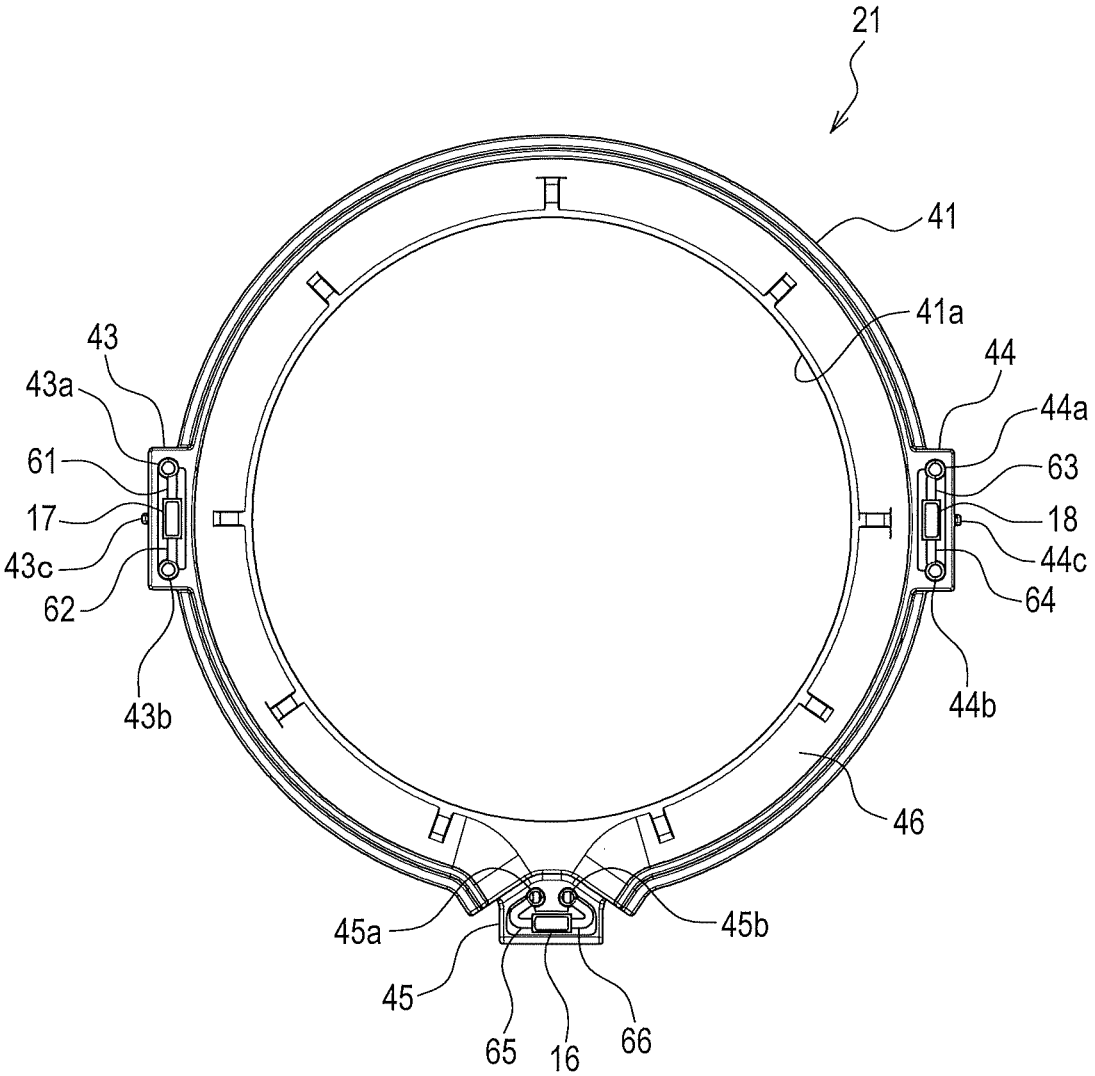
FIG. 6 is a front view of the reflector of the first embodiment.

As shown in FIG. 5, the light guide 22 has a ring-shape. As shown in FIG. 3 and FIG. 5, the reflector 21 and the cover 23 each have, for example, a ring-shape. More specifically, in the first embodiment, the light guide 22, the reflector 21 and the cover 23 each have, for example, a circular ring-shape. The reflector 21 is arranged behind the light guide 22. The cover 23 is arranged in front of the light guide 22. The cover 23 is attached to the reflector 21 so as to cover the light guide 22.

The light unit 10 is detachably attached to the housing 3. As shown in FIG. 3, the reflector 21 includes a first engaging portion 47 and a second engaging portion 48. The first engaging portion 47 includes a first hole 47*a*. The second engaging portion 48 includes a second hole 48*a*. The driving mechanism 13 includes a first engaged portion 13*a* and a second engaged portion 13*b*. The first engaged portion 13*a* and the second engaged portion 13*b* each include, for example, a cylindrical protrusion.

To attach the light unit 10, the light unit 10 is moved from the front of the electric working machine 1 toward the electric working machine 1 (i.e. moved backward) while inserting the chuck sleeve 11 into the opening of the light unit 10. Then, the first engaging portion 47 comes in contact with the first engaged portion 13*a*, and the second engaging portion 48 comes in contact with the second engaged portion 13*b*. Thereafter, the light unit 10 is further moved backward, and the first engaged portion 13*a* is engaged with the first hole 47*a*, and the second engaged portion 13*b* is engaged with the second hole 48*a*. Accordingly, the light unit 10 is attached to the driving mechanism 13, and thus, to the main body 2. To remove the light unit 10, the light unit 10, which is attached to the main body 2, is pulled forward, for example. Then, the first engaging portion 47 is disengaged from the first engaged portion 13*a*, and the second engaging portion 48 is disengaged from the second engaged portion 13*b*. Accordingly, the light unit 10 is removed from the main body 2.

In a manufacturing process of the electric working machine 1, for example, the light unit 10 may be attached to the driving mechanism 13 before the driving mechanism 13 is housed in the housing 3. Then the driving mechanism 13, which has the light unit 10 attached thereto, may be housed in the housing 3. However, the light unit 10 may be attachable to the driving mechanism 13 that is housed in the housing 3. The light unit 10 may be attached in any way. For example, the light unit 10 may be attached to the main body 2 by engaged with a portion other than the driving mechanism 13 of the main body 2. In a state where the driving mechanism 13 is housed in the housing 3 (FIG. 1), for example, the light unit 10 may be restricted from being removed from the housing 3.

The first to third LEDs 16-18 are, for example, provided to the reflector 21 in the first embodiment. The second and third LEDs 17-18 are arranged symmetrically about the rotation axis.

The cover 23 has a light transmittance of more than zero. The cover 23 may have the light transmittance ranged from, for example, 50% to 100%. The light emitted from the second and third LEDs 17-18 passes though the cover 23 toward the surrounding area (mainly toward the front) of the electric working machine 1. The cover 23 may include a portion having the light transmittance of zero.

The light emitted from the second LED 17 has an optical axis (hereinafter, referred to as "right optical axis"), and the light emitted from the third LED 18 may has an optical axis (hereinafter, referred to as "left optical axis"), and these optical axes intersect with the rotation axis. The right optical axis and the left optical axis may intersect with the rotation axis at the same position or at different positions. For example, one of the right optical axis and the left optical axis may intersect with the rotation axis at a first position in the rotation axis. The first position may correspond to a distal end of a shortest tool. The other axis of the right optical axis and the left optical axis may intersect with the rotation axis at a second position in the rotation axis. The second position may correspond to a distal end of a longest tool. In still another example, both the right optical axis and the left optical axis may intersect with the rotation axis at the first position. In still another example, both the right optical axis and the left optical axis may intersect with the rotation axis at the second position. In still another example, both the right optical axis and the left optical axis may intersect with the rotation axis at an optional position between the first position and the second position.

The light emitted from the first LED 16 enters the light guide 22. The light guide 22 radiates the light, which entered the light guide 22, from a surface of the light guide 22 while reflecting and propagating the light inside the light guide 22. In the first embodiment, for example, the light guide 22 radiates the light, which entered the light guide 22, from a roughly entire surface of the light guide 22. In other words, the light guide 22 of the first embodiment annularly radiates the light. The light radiated from the light guide 22 passes through the cover 23 toward the surrounding area of the electric working machine 1.

(1-2) Electrical Configuration of Electric Working Machine

Electrical configurations of the electric working machine 1 will be supplementary described with reference to FIG. 4. FIG. 4 shows the electric working machine 1 having the battery pack 100 attached to the main body 2.

The battery pack 100 includes a battery 101. The battery 101 may be, for example, a rechargeable battery. The battery 101 may be, for example, a lithium-ion battery. The battery 101 may be a rechargeable battery different from the lithium-ion battery.

The battery pack 100 includes a positive terminal 101*a* and a negative terminal 101*b*. The positive terminal 101*a* is coupled to a positive electrode of the battery 101. The negative terminal 101*b* is coupled to a negative electrode of the battery 101.

The main body 2 includes the above-described motor 12, the trigger 8, the rotation direction selector 9, the first to third LEDs 16-18, and further includes the controller 31, a trigger switch 32, a select switch 33, a positive terminal 2*a*, and a negative terminal 2*b*.

In response to the battery pack 100 attached to the main body 2, the positive terminal 2*a* of the main body 2 is coupled to the positive terminal 101*a* of the battery pack 100, and the negative terminal 2*b* of the main body 2 is coupled to the negative terminal 101*b* of the battery pack 100. This may supply electric power from the battery 101 to the controller 31. The controller 31 is powered by electricity from the battery 101.

The trigger switch 32 is turned on or off in accordance with a position of the trigger 8. For example, the trigger switch 32 is turned off while the trigger 8 is not pulled. In response to the trigger 8 pulled to a specified extent or more, the trigger switch 32 is turned on. The trigger switch 32 outputs a trigger signal to the controller 31. The trigger signal indicates an on/off state of the trigger switch 32.

The select switch 33 outputs a select signal to the controller 31. The select signal indicates a position of the rotation direction selector 9.

The controller 31 performs various functions that the electric working machine 1 has. For example, based on the trigger signal, the controller 31 drives the motor 12 while the trigger switch 32 is turned on. The controller 31 rotates the motor 12 in a rotation direction based on the select signal.

The controller 31 further turns on the first to third LEDs 16-18 in response to a lighting condition being satisfied. The lighting condition may be satisfied at any timing. For example, the lighting condition may be satisfied in response to the trigger switch 32 turned on. In other words, the controller 31 may turn on the first to third LEDs 16-18 while the trigger switch 32 is turned on.

(1-3) Configuration of Light Unit

Specific configurations of the light unit 10 will be described with reference to FIG. 5 to FIG. 13.

Firstly, the reflector 21 will be described with reference to FIG. 5 to FIG. 8. The reflector 21 includes the above-described wiring bar 42, the first engaging portion 47, and the second engaging portion 48, and further includes a reflecting member 41, a first mounting portion 45, a second mounting portion 43, and a third mounting portion 44.

The reflecting member 41 includes a reflector opening 41*a*. The reflecting member 41 has a ring-shape, for example. The reflecting member 41 has the first mounting portion 45, the second mounting portion 43, the third mounting portion 44, the first engaging portion 47 and the second engaging portion 48 formed thereon. The wiring bar 42 is arranged so as to extend from the first mounting portion 45.

The reflecting member 41 further includes a groove 46. The groove 46 is formed into a ring-shape along a circumferential direction of the reflecting member 41. The groove 46 is engaged with the light guide 22. In other words, the groove 46 is formed so as to correspond to a ring-shape of the light guide 22 (i.e. so that the light guide 22 fits in the groove 46). The light guide 22 is attached to the reflector 21 so that a roughly entire portion of the light guide 22 faces the reflecting member 41.

The reflector 21 of the first embodiment may be, for example, a resin-molded member integrally molded with a material containing a resin. The reflector 21 may contain, for example, a thermosetting resin. The reflector 21 may contain, for example, a thermoplastic resin. The reflector 21 may contain, for example, only a resin. The reflector 21 may contain, for example, a resin and an insulating member different from the resin. The reflector 21 may contain, for example, only an insulating member different from a resin.

The reflector 21 may be formed by any method. The reflector 21 may be formed by, for example, injection molding. The reflector 21 may be formed by a method different from the injection molding.

The first mounting portion 45 includes the first LED 16 arranged thereon. The first mounting portion 45 includes a first wiring 65, a second wiring 66, a first through hole 45*a*, and a second through hole 45*b* arranged thereon. The first wiring 65 includes a first end coupled to a first terminal of the first LED 16. The first wiring 65 includes a second end coupled to the first through hole 45*a*. The second wiring 66 includes a first end coupled to a second terminal of the first LED 16. The second wiring 66 includes a second end coupled to the second through hole 45*b*.

The second mounting portion 43 includes the second LED 17 arranged thereon. The second mounting portion 43 includes a third wiring 61, a fourth wiring 62, a third through hole 43*a*, and a fourth through hole 43*b* arranged thereon. The third wiring 61 includes a first end coupled to a first terminal of the second LED 17. The third wiring 61 includes a second end coupled to the third through hole 43*a*. The fourth wiring 62 includes a first end coupled to a second terminal of the second LED 17. The fourth wiring 62 includes a second end coupled to the fourth through hole 43*b*.

The third mounting portion 44 includes the third LED 18 arranged thereon. The third mounting portion 44 includes a fifth wiring 63, a sixth wiring 64, a fifth through hole 44*a*, and a sixth through hole 44*b* arranged thereon. The fifth wiring 63 includes a first end coupled to a first terminal of the third LED 18. The fifth wiring 63 includes a second end coupled to the fifth through hole 44*a*. The sixth wiring 64 includes a first end coupled to a second terminal of the third LED 18. The sixth wiring 64 includes a second end coupled to the sixth through hole 44*b*.

The second mounting portion 43 further includes a third engaged portion 43*c* arranged thereon. The third mounting portion 44 further includes a fourth engaged portion 44*c* arranged thereon. The third engaged portion 43*c* is engaged with a below-described third engaging portion 56 of the cover 23. The fourth engaged portion 44*c* is engaged with a below-described fourth engaging portion 57 of the cover 23.

Figure 7:
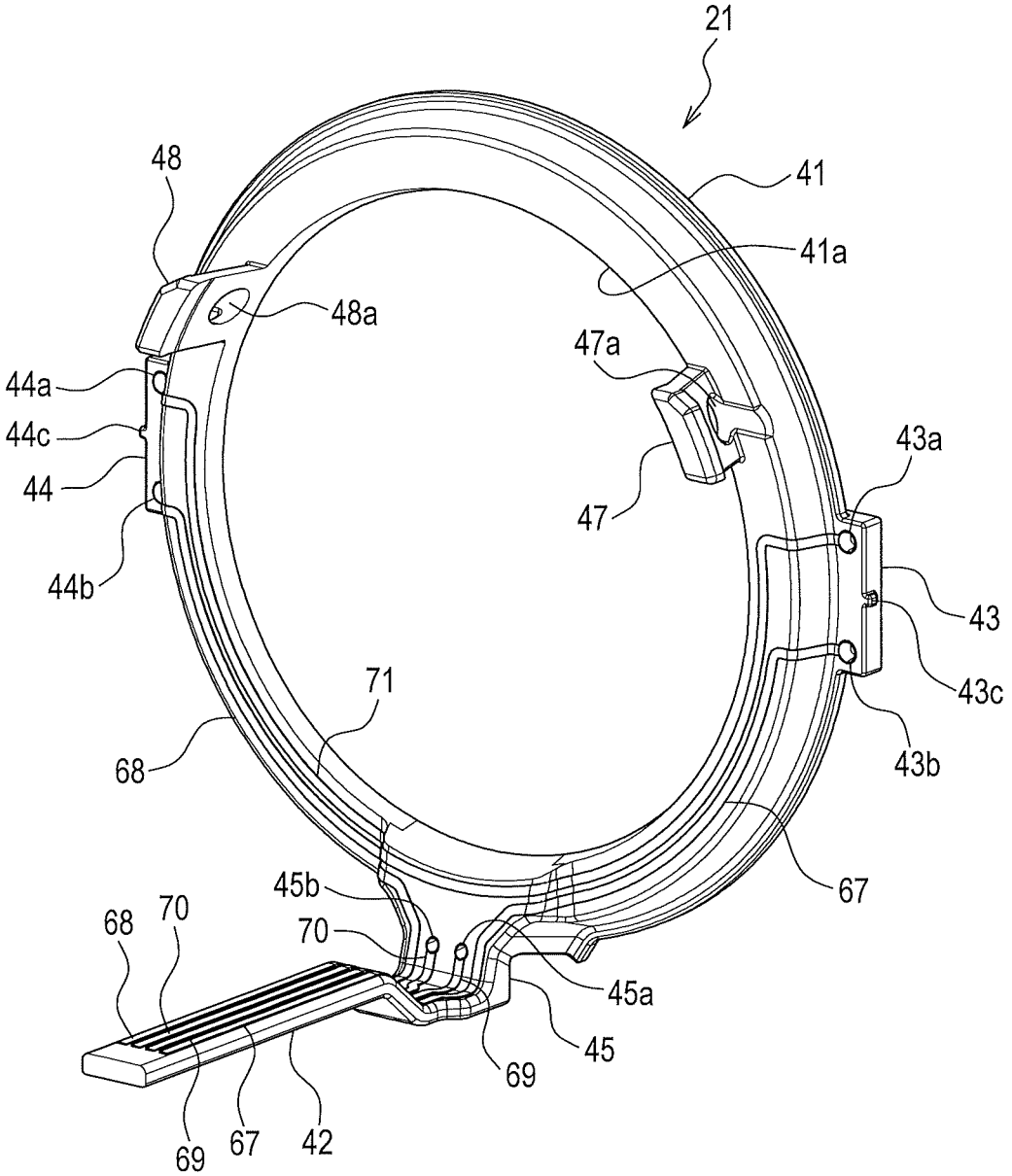
FIG. 7 is a rear perspective view of the reflector of the first embodiment.

The wiring bar 42 includes a seventh wiring 67, an eighth wiring 68, a ninth wiring 69, and a tenth wiring 70. The reflecting member 41 includes an eleventh wiring 71 provided to a back surface thereof as shown in FIG. 7.

The seventh wiring 67 has a first end coupled to the fourth through hole 43*b*. The seventh wiring 67 has a second end coupled to the controller 31.

The eighth wiring 68 has a first end coupled to the sixth through hole 44*b*. The eighth wiring 68 has a second end coupled to the controller 31.

The ninth wiring 69 has a first end coupled to the first through hole 45*a*. The ninth wiring 69 has a second end coupled to the controller 31.

The tenth wiring 70 has a first end coupled to the second through hole 45*b*. The tenth wiring 70 has a second end coupled to the controller 31.

The eleventh wiring 71 has a first end coupled to the third through hole 43*a*. The eleventh wiring 71 has a second end coupled to the fifth through hole 44*a*.

The controller 31 supplies electric power to the first LED 16 to turn it on via the ninth and tenth wirings 69, 70. The controller 31 supplies electric power to the second and third LEDs 17-18 to turn them on via the seventh, eighth, and eleventh wirings 67, 68 and 71.

Hereinafter, the first to eleventh wirings 61-71, the third, fourth, fifth, sixth through holes 43*a*, 43*b*, 44*a*, 44*b*, and the first and second through holes 45*a*, 45*b* are collectively referred to as "wiring element group". The wiring element group may employ any forms. The wiring element group may be arranged by any method. In the first embodiment, the wiring element group is integrally molded with the reflector 21 on the surface of the reflector 21.

In other words, the reflector 21 of the first embodiment is one type of Molded Interconnect Device (MID). The MID is a resin-molded member having a conductor trace (or printed wiring or patterned conductor) formed thereon. In the reflector 21, the wirings 61-71 are formed as conductor traces.

The MID may be manufactured by various methods. The methods for manufacturing the MID may include well-known Laser Direct Structuring (LDS). The wiring element group may be formed on the reflector 21 by LDS, for example.

Figure 8:
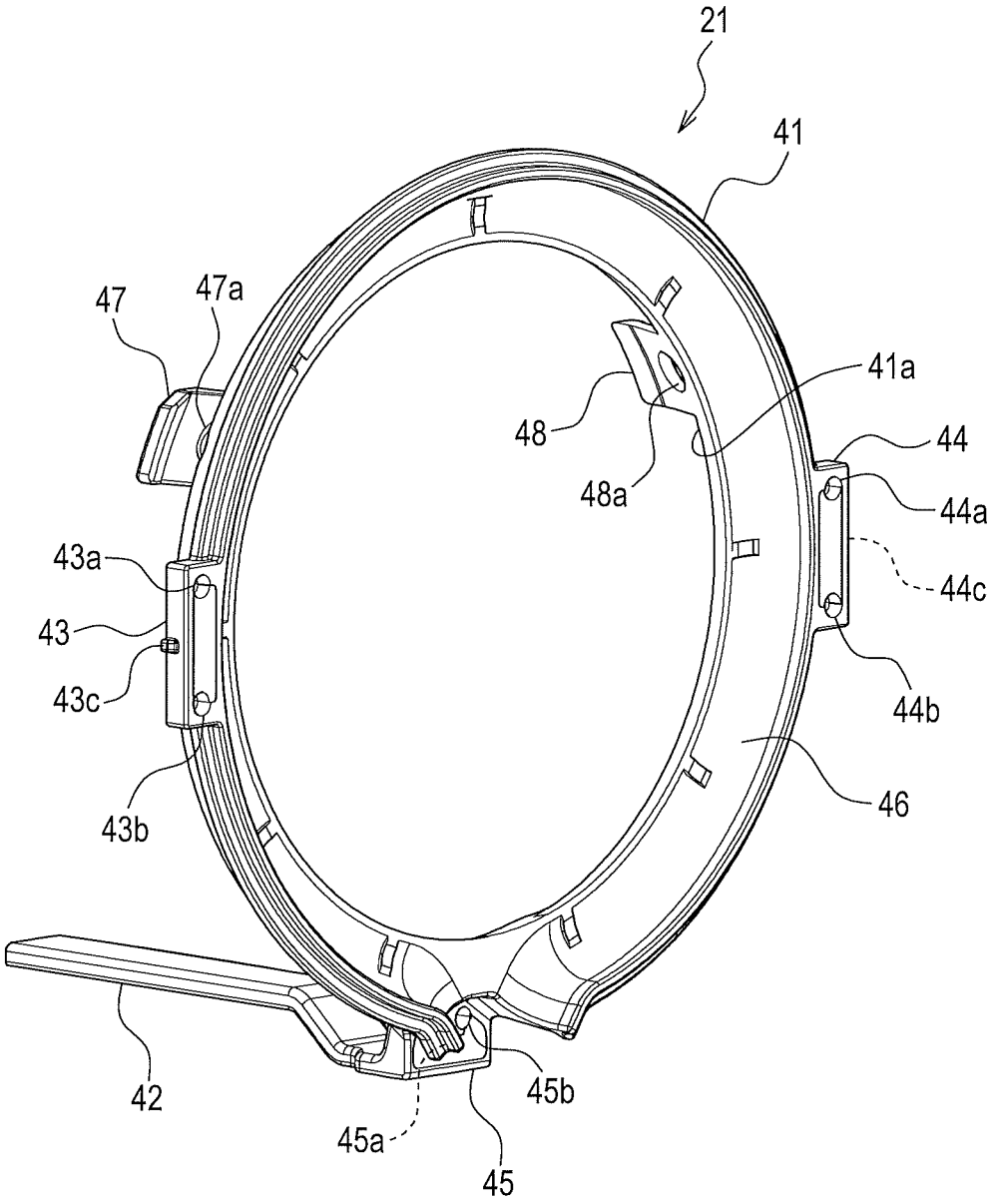
FIG. 8 is a front perspective view of the reflector of the first embodiment.
Figure 9:
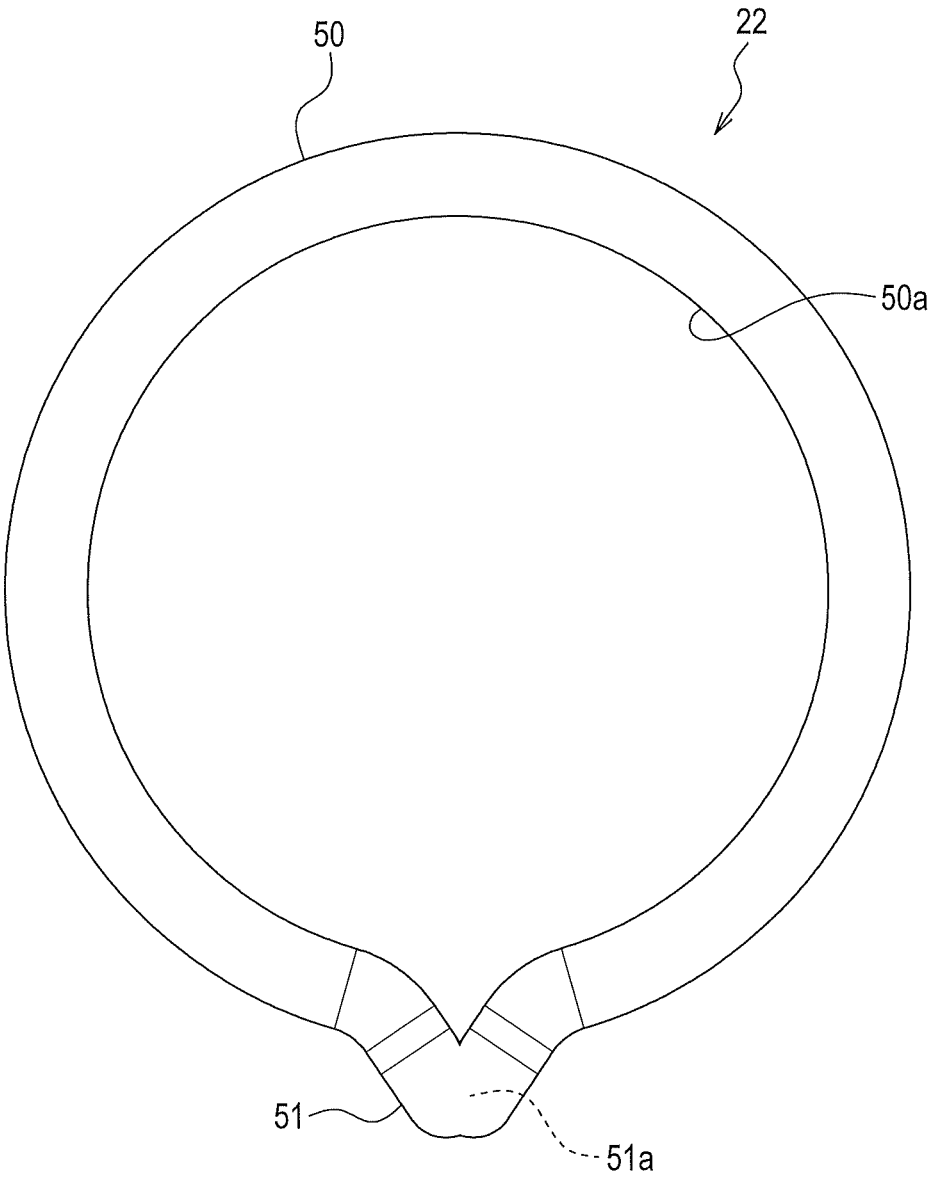
FIG. 9 is a front view of the light guide of the first embodiment.
Figure 10:
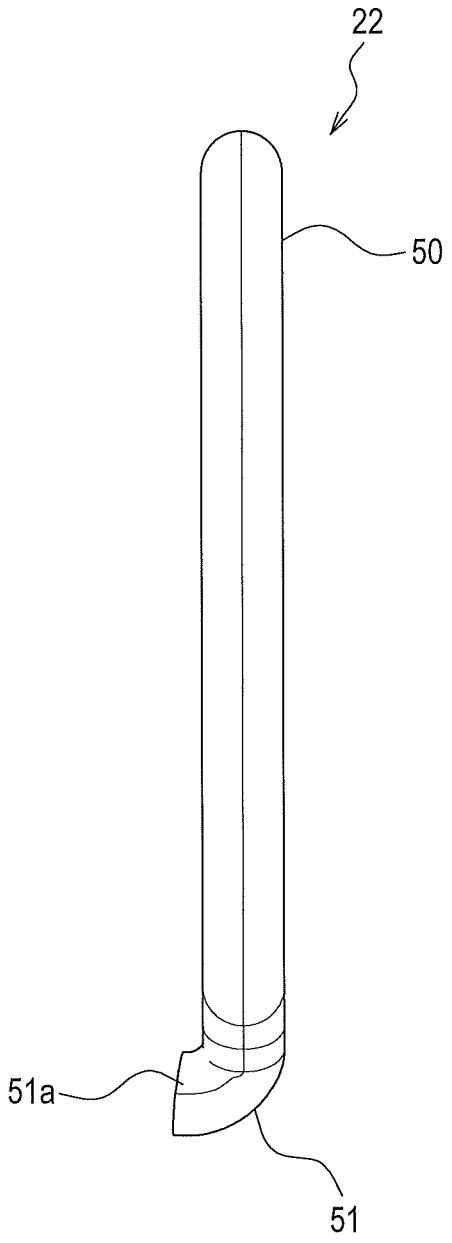
FIG. 10 is a left side view of the light guide of the first embodiment.
Figure 11:
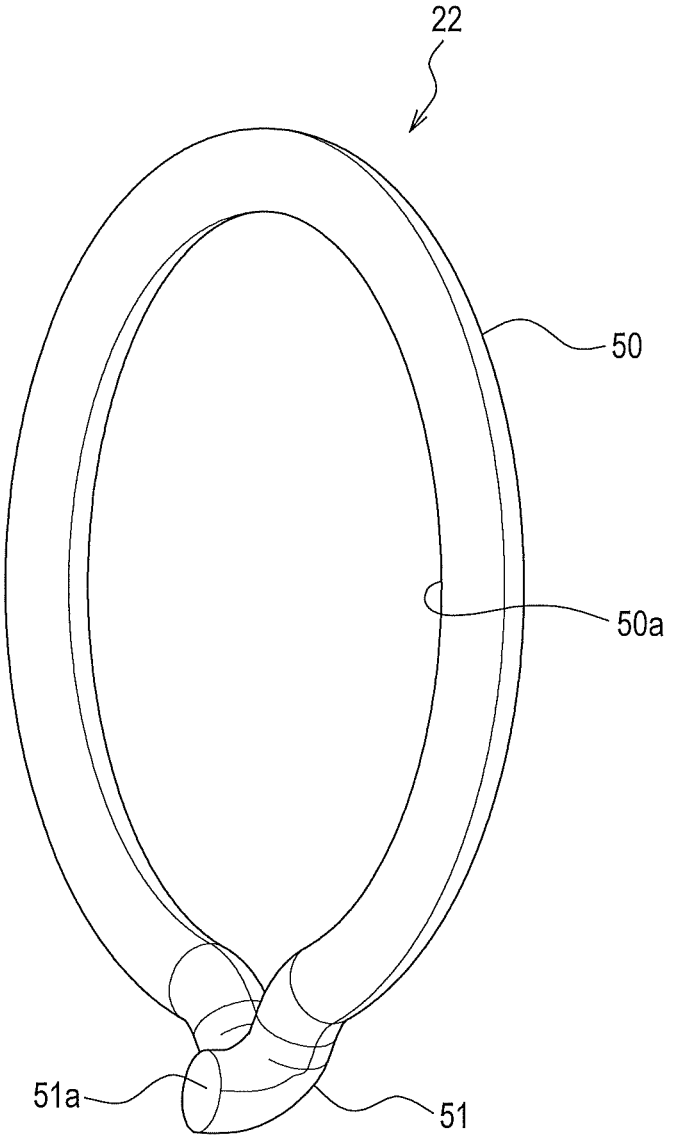
FIG. 11 is a rear perspective view of the light guide of the first embodiment.

As shown in FIG. 8, the reflector 21 immediately after the integral formation does not yet have the wiring element group. The wiring element group may be formed, for example, by LDS or other method on the integrally molded reflector 21. The first to third LEDs 16-18 may be attached to the reflector 21 that has the wiring element group formed thereon.

Figure 12:
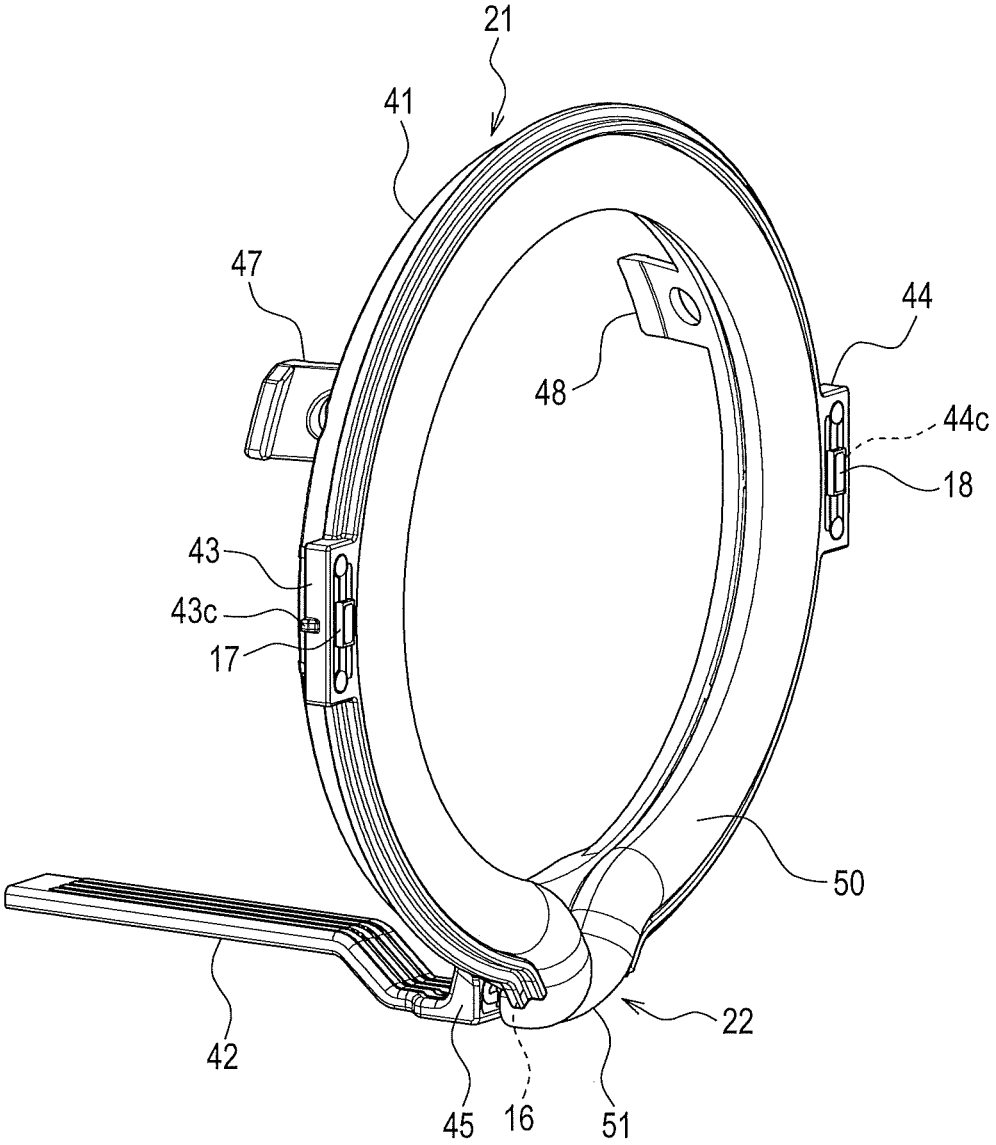
FIG. 12 is a front perspective view of the light unit of the first embodiment, with the cover removed.
Figure 13:
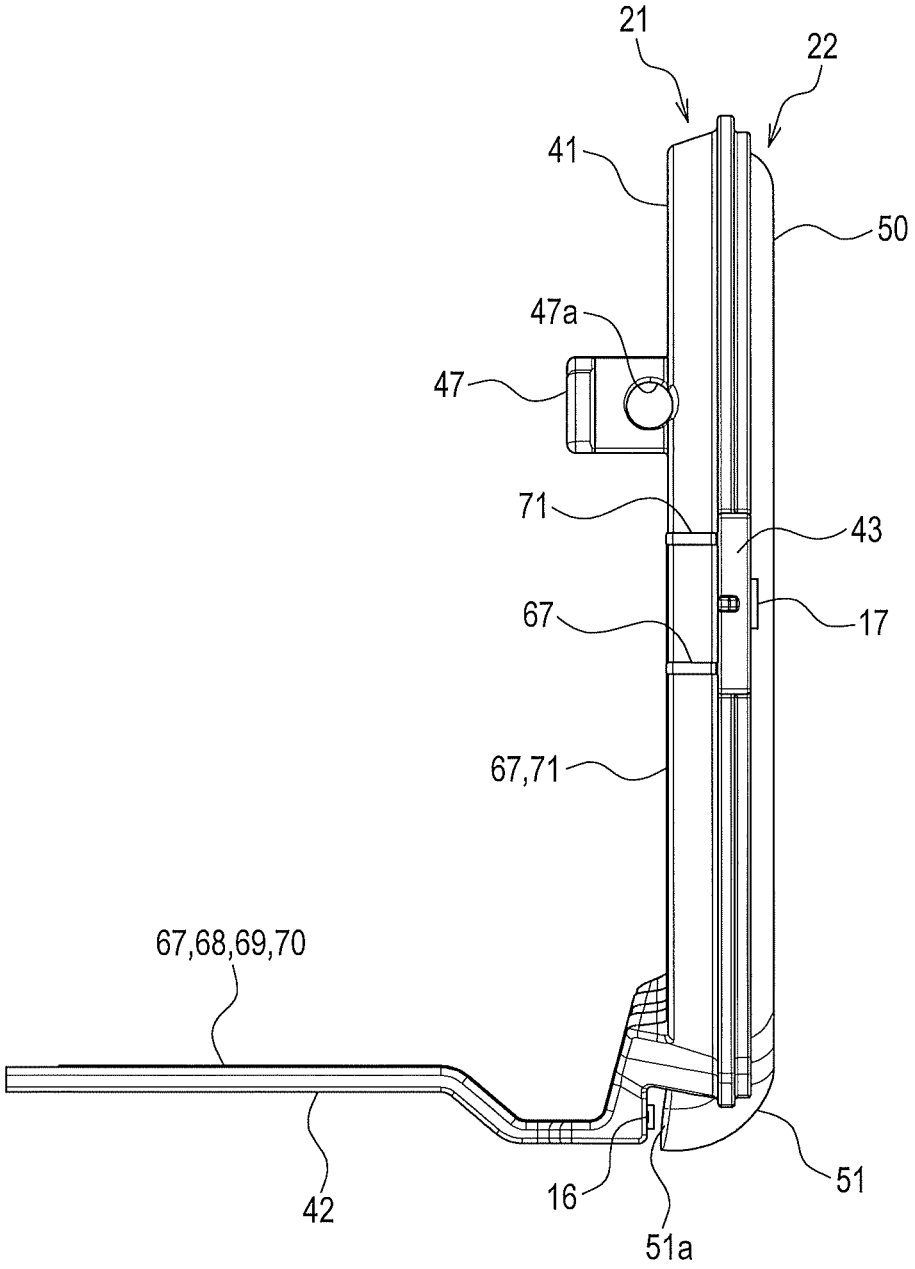
FIG. 13 is a left side view of the light unit of the first embodiment, with the cover removed.

Next, the light guide 22 will be described with reference to FIG. 5, FIG. 9 to FIG. 11. The light guide 22 includes a light guide member 50. The light guide member 50 includes a light guide opening 50*a*. The light guide member 50 has a ring-shape, for example. The light guide member 50 is fitted into the groove 46. FIG. 12 and FIG. 13 show the light unit 10 without the cover 23. In FIG. 12 and FIG. 13, the light guide 22 is fitted into the groove 46.

The light guide member 50 includes a light entering portion 51. The light entering portion 51 includes a light entering surface 51*a*. As shown in FIG. 13, the light entering surface 51*a* faces the first LED 16. The light emitted from the first LED 16 enters the light entering surface 51*a*.

As shown in FIG. 5, the light entering surface 51*a* does not intersect with a first virtual plane orthogonal to a center axis 150 of the light guide 22 (the first virtual plane is referred to as "axially orthogonal plane"). More specifically, in the first embodiment, the light entering surface 51*a* is parallel to the axially orthogonal plane. In other words, in the first embodiment, the center axis 150 intersects with (e.g. is orthogonal to) a second virtual plane parallel to the light entering surface 51*a*. In the first embodiment, the center axis 150 coincides with the rotation axis. However, the center axis 150 does not necessarily coincide with the rotation axis. In the first embodiment, the center axis 150 coincide with a center axis of the reflector 21 (i.e. a center axis of the reflecting member 41). However, the center axis 150 does not necessarily coincide with the center axis of the reflector 21. The front direction (corresponding to the second direction in this disclosure) and the rear direction (corresponding to the first direction in this disclosure) intersect with (e.g. are orthogonal to) the axially orthogonal plane.

As shown in FIG. 5, the light guide member 50 propagates the light, which entered the light entering surface 51*a*, from the light entering surface 51*a* to a first circumferential direction 52 and to a second circumferential direction 53 of the light guide member 50. The second circumferential direction 53 is opposite the first circumferential direction 52. In other words, the light entered the light entering surface 51*a* is separated into two directions at the light entering portion 51, and propagates inside the light guide member 50. While being reflected and propagating inside the light guide member 50, the light entered the light entering surface 51*a* is radiated from a roughly entire surface of the light guide member 50 except for the light entering surface 51*a*.

A part or all of the light radiated from the light guide 22 in the rear direction of the electric working machine 1 is reflected by the reflector 21 and guided in the front direction of the electric working machine 1.

Next, the cover 23 will be described with reference to FIG. 5. The cover 23 includes a cover member 55. The cover member 55 includes a cover opening 55*a*. The cover member 55 has a ring-shape, for example. The cover member 55 has a light transmittance of more than zero. The light radiated from the light guide 22, the second LED 17 and the third LED 18 passes through the cover member 55 toward the surrounding area (mainly in the front direction) of the electric working machine 1.

The cover 23 is attached to the reflector 21. The cover 23 attached to the reflector 21 covers the light guide 22 in a circumferential direction of the light guide 22. The cover member 55 includes the third engaging portion 56 and the fourth engaging portion 57.

The cover 23 covers the reflector 21 having the light guide 22 fitted therein (see FIG. 12 and FIG. 13*a*). This allows the third engaging portion 56 to engage with the third engaged portion 43*c* and allows the fourth engaging portion 57 to engage with the fourth engaged portion 44*c*. Thus, as shown in FIG. 5, the cover 23 is attached to the reflector 21, and consequently, the reflector 21, the light guide 22 and the cover 23 are attached to each other.

(1-4) Effects of First Embodiment

In the above-described first embodiment, the light from the first LED 16 enters the light guide 22. The light guide 22 emits the entered light from the surface of the light guide 22. This allows to suitably illuminate the surrounding area of the electric working machine 1, and the workability of the electric working machine 1 improves.

In addition, the light guide 22 annularly emits light from the first LED 16. Thus, the light guide 22 may serve as illumination having decorative and design properties. The light guide 22 also allows a user of the electric working machine 1 and/or a person near the electric working machine 1 to have a visual sense of beauty.

In addition, in the first embodiment, a part or all of the light radiated from the light guide 22 in the rear direction is reflected in the front direction by the reflector 21. Thus, the electric working machine 1 can illuminate the front area thereof more brightly.

Furthermore, in the first embodiment, the electric working machine 1 illuminates the surrounding area thereof by the second LED 17 and the third LED 18 in addition to the light guide 22. Thus, the workability of the electric working machine 1 can further improve.

The reflector 21 of the first embodiment is formed as a MID. In other words, the first to third LEDs 16-18 and the wiring element group are integrally provided on the surface of the reflector 21. This may reduce man-hours to mount various parts and wiring for illumination.

In the first embodiment, the grip 6 corresponds to one example of a grip in the present disclosure. The first LED 16 corresponds to one example of a first light emitter in the present disclosure. The second LED 17 and the third LED 18 each correspond to one example of a second light emitter in the present disclosure. The reflecting member 41 corresponds to one example of an annular member in the present disclosure. The first wiring 65, the second wiring 66, the ninth wiring 69 and the tenth wiring 70 each correspond to one example of a first conductor trace in the present disclosure. The third wiring 61, the fourth wiring 62, the fifth wiring 63, the sixth wiring 64, the seventh wiring 67, the eighth wiring 68 and the eleventh wiring 71 each correspond to one example of a second conductor trace in the present disclosure. The front direction corresponds to one example of a second direction in the present disclosure. The rear direction corresponds to one example of a first direction in the present disclosure.

[2. Second Embodiment]

(2-1) Configuration of Electric Working Machine

Figure 14:
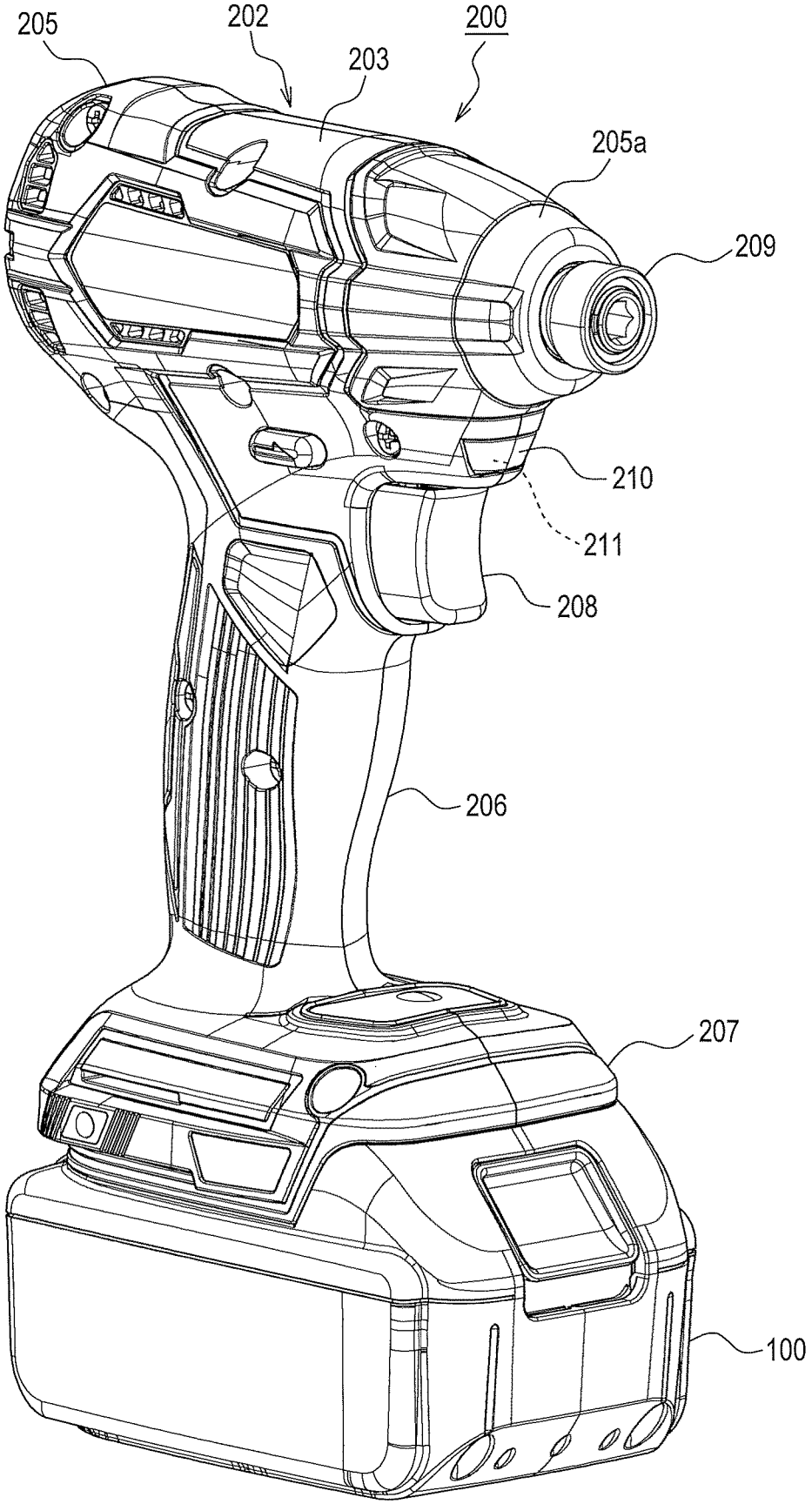
FIG. 14 is a front perspective view of an electric working machine of a second embodiment.

As shown in FIG. 14, an electric working machine 200 of a second embodiment is different from the electric working machine 1 of the first embodiment in the following three points. The first difference is that the electric working machine 200 does not comprise the light unit 10. The second difference is that a light emitter 211 is built in the electric working machine 200. The third difference is that an illuminator attachment 215 (FIG. 16) can be freely attached to and removed from the electric working machine 200.

The electric working machine 200 of the second embodiment is substantially the same as the electric working machine 1 of the first embodiment except for the first to the third differences. That is, as shown in FIG. 14, the electric working machine 200 of the second embodiment includes a main body 202. The main body 202 includes a housing 203. The housing 203 includes, as in the case of the housing 3 of the first embodiment, two half housings divided into left and right. The main body 202 includes a first storage 205, a grip 206, and a second storage 207. The first storage 205 has a first end where a chuck sleeve 209 is provided.

The first storage 205 has a cylindrical shape. However, the first storage 205 has a front portion (i.e. a portion including the first end) has a substantially circular truncated cone shape. In other words, the front portion of the first storage 205 has a diameter gradually reduced toward the front direction. The front portion of the first storage 205 includes a tip outer peripheral surface 205*a*. The tip outer peripheral surface 205*a* comes into contact with first to third supports 261 to 263 (FIG. 16) of an illuminator attachment 215 as described below.

The first end of the first storage 205 has a light emitter 211. The light emitter 211 is arranged below the chuck sleeve 209. The light emitter 211 emits light in the front direction of the electric working machine 200. The light emitter 211 is covered with an illuminator cover 210. The illuminator cover 210 makes the light pass through.

Figure 15:
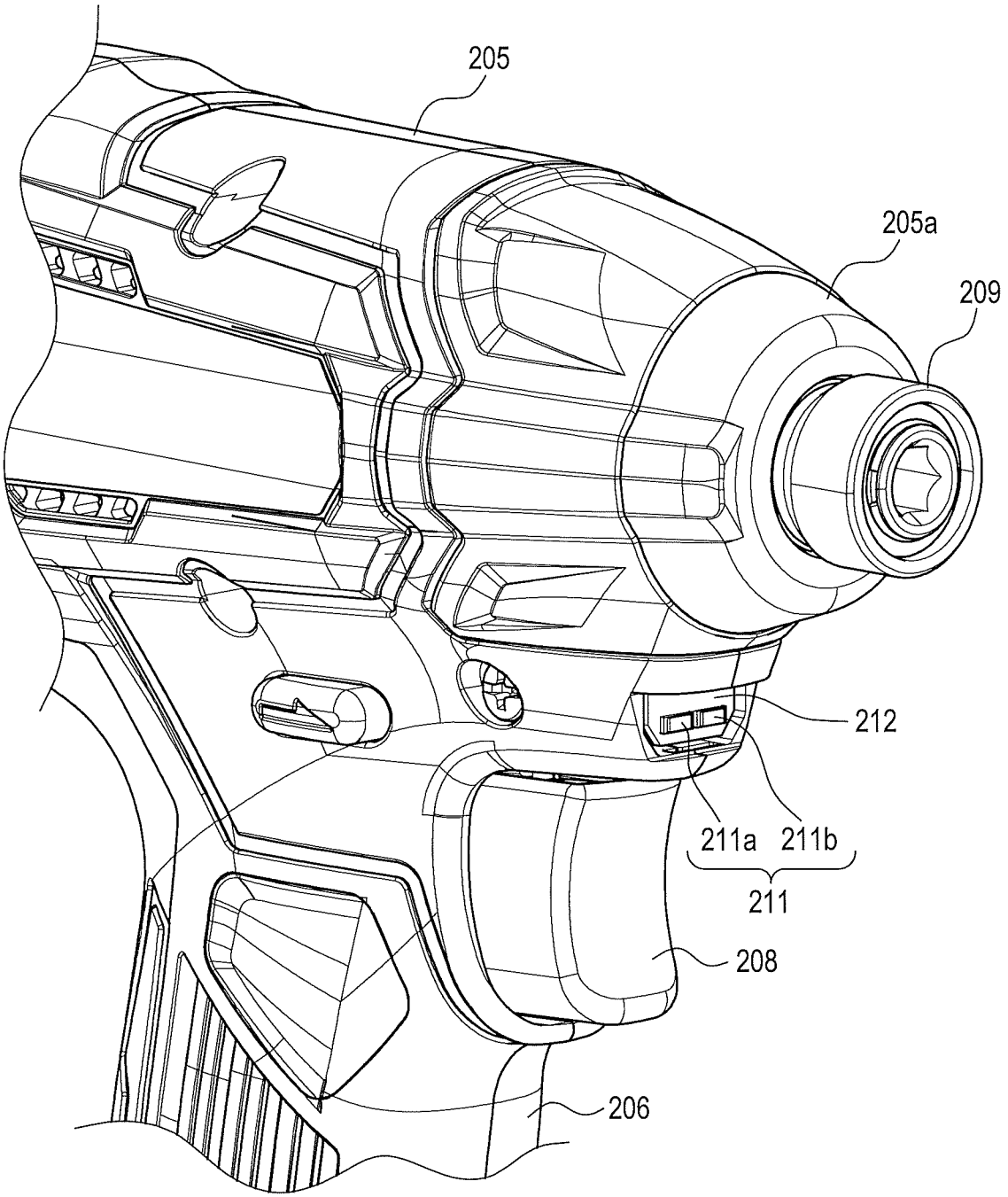
FIG. 15 is a front perspective view of the electric working machine of the second embodiment, with an illuminator cover removed.

As shown in FIG. 15, the light emitter 211 of the second embodiment includes, for example, two LEDs 211*a*, 211*b*. These LEDs 211*a*, 211*b* are provided to a circuit board 212. The light emitted from the light emitter 211 is radiated in the front direction via the illuminator cover 210. The illuminator cover 210 may include, for example, a transparent material. The illuminator cover 210 may have, for example, the light transmittance of 100%. The illuminator cover 210 may have, for example, the light transmittance of less than 100%.

Figure 16:
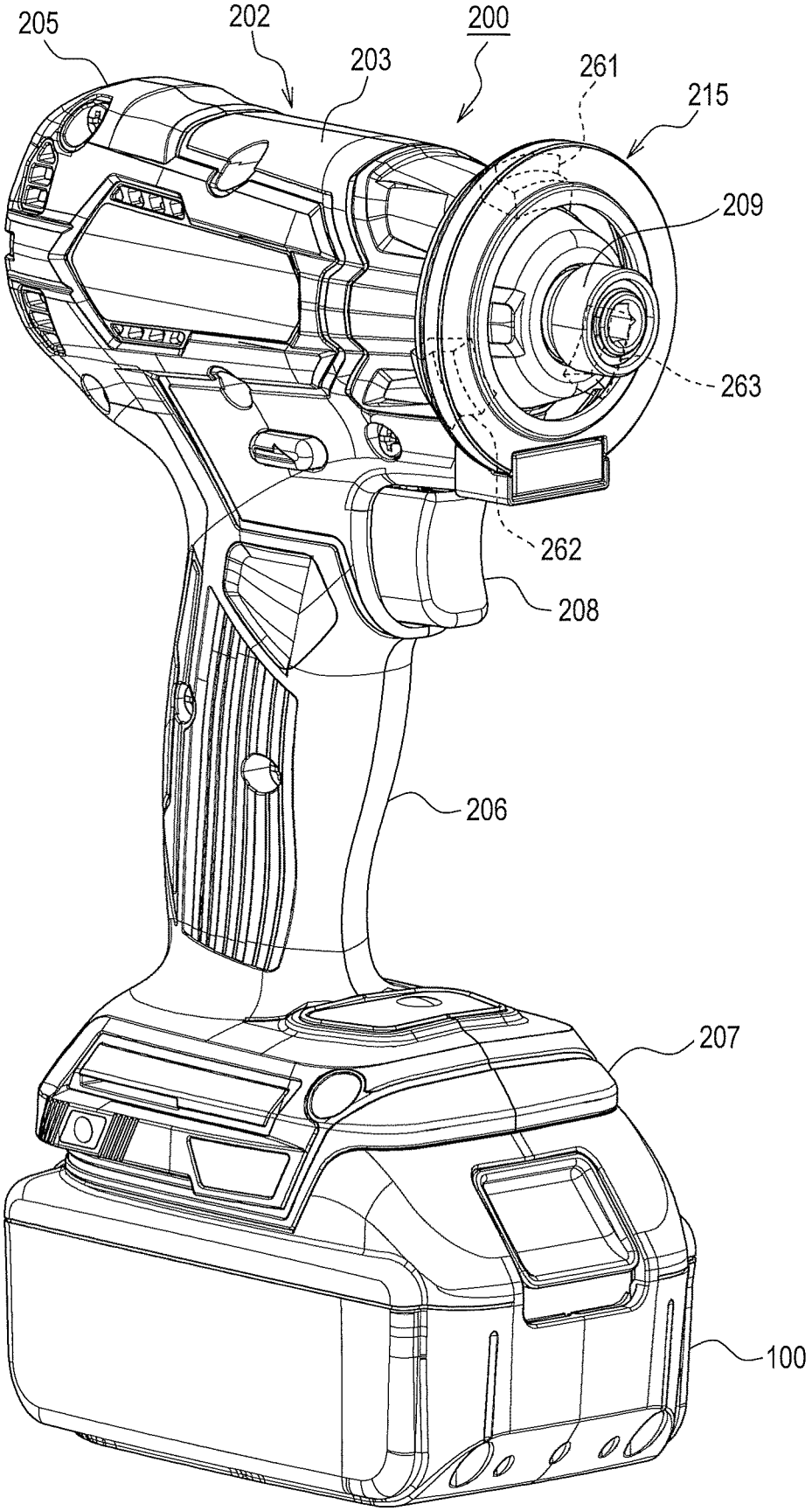
FIG. 16 is a front perspective view of the electric working machine of the second embodiment, with the illuminator attachment attached.

The light emitted from the light emitter 211 can brightly illuminate a surrounding area (especially, the front direction) of the electric working machine 200. In the second embodiment, the illuminator attachment 215 is further provided to the electric working machine 200 as an attachment. The illuminator attachment 215 is attached to the electric working machine 200 as shown in FIG. 16. In response to the illuminator attachment 215 attached to the electric working machine 200, the light emitted from the light emitter 211 is annularly radiated toward the surrounding area of the electric working machine 200 via the illuminator attachment 215. Therefore, it is possible to illuminate a wider range of the surrounding area of the electric working machine 200 by attaching the illuminator attachment 215 to the electric working machine 200.

The electric working machine 200 of the second embodiment may be, for example, embodied (e.g. sold) without the illuminator attachment 215. Alternatively, for example, the electric working machine 200 and the illuminator attachment 215 may be embodied in one set. Alternatively, for example, the illuminator attachment 215 may be solely embodied.

Figure 17:
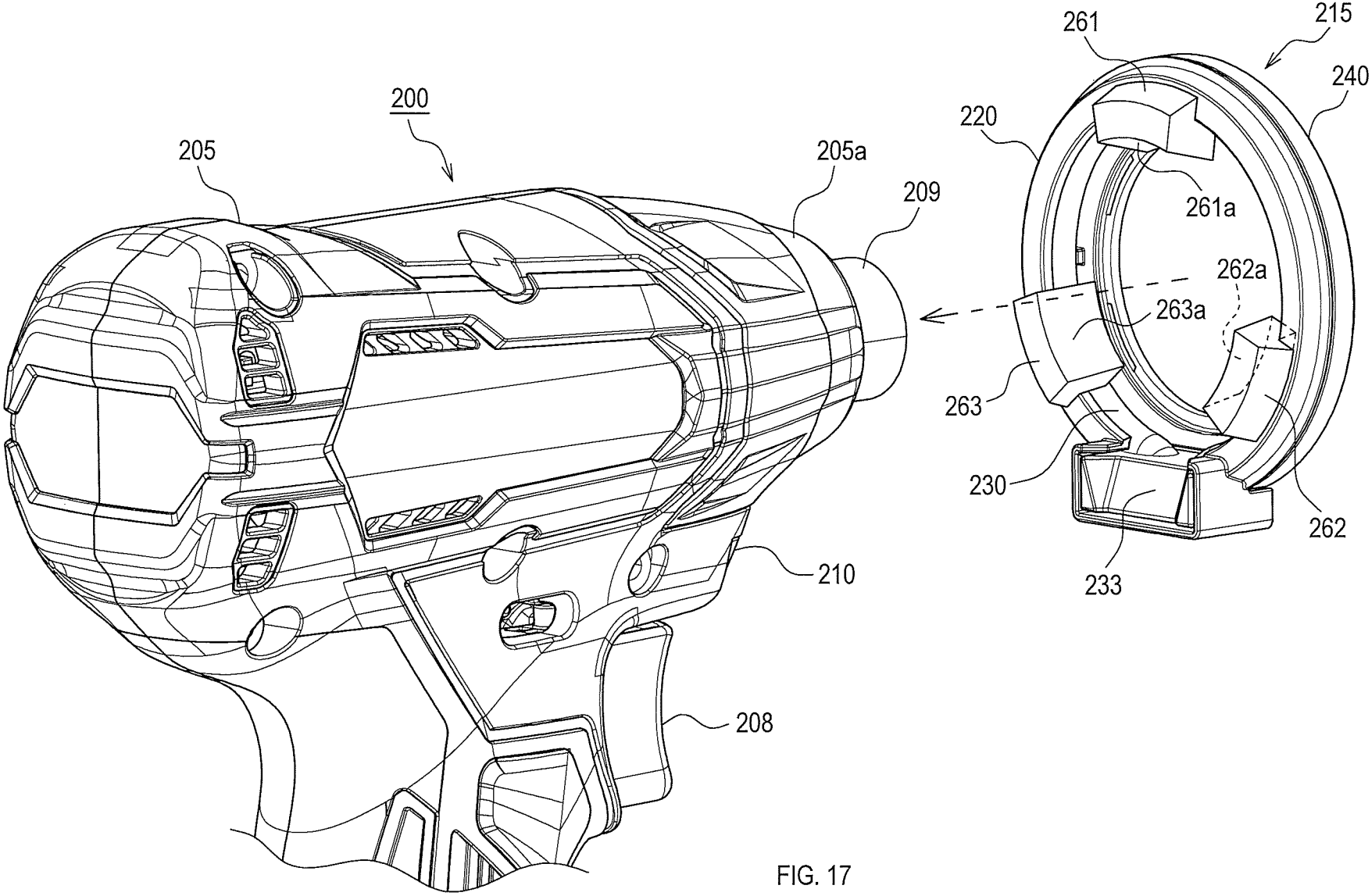
FIG. 17 is a rear perspective view of the electric working machine and the illuminator attachment of the second embodiment.

As shown in FIG. 16 and FIG. 17, the illuminator attachment 215 has a ring-shape. The illuminator attachment 215 includes an opening. The illuminator attachment 215 includes at least one support. The at least one support is arranged along an inner circumference of the illuminator attachment 215. In the second embodiment, the illuminator attachment 215 includes, for example, a first support 261, a second support 262, and a third support 263. The first to third supports 261 to 263 are, for example, arranged at regular intervals with each other along the circumferential direction of the illuminator attachment 215.

As shown in FIG. 17, the first support 261 includes a first supporting surface 261*a*. A part or all of the first support 261 is elastically deformable. Specifically, in response to the first supporting surface 261*a* receiving pressure, the first support 261 is elastically deformed in a direction where the pressure is applied. In other words, the first support 261 is compressed in the direction where the pressure is applied. The elastically deformable portion of the first support 261 may include any materials. The elastically deformable portion may include, for example, rubber, sponge, and a spring.

The second support 262 and the third support 263 each are configured to be substantially same as the first support 261. That is, the second support 262 includes a second supporting surface 262*a*. In response to the second supporting surface 262*a* receiving pressure, the second support 262 is elastically deformed in a direction where the pressure is applied. The third support 263 includes a third supporting surface 263*a*. In response to the third supporting surface 263*a* receiving pressure, the third support 263 is elastically deformed in a direction where the pressure is applied.

(2-2) Detailed Configuration of Illuminator Attachment

Figure 18:
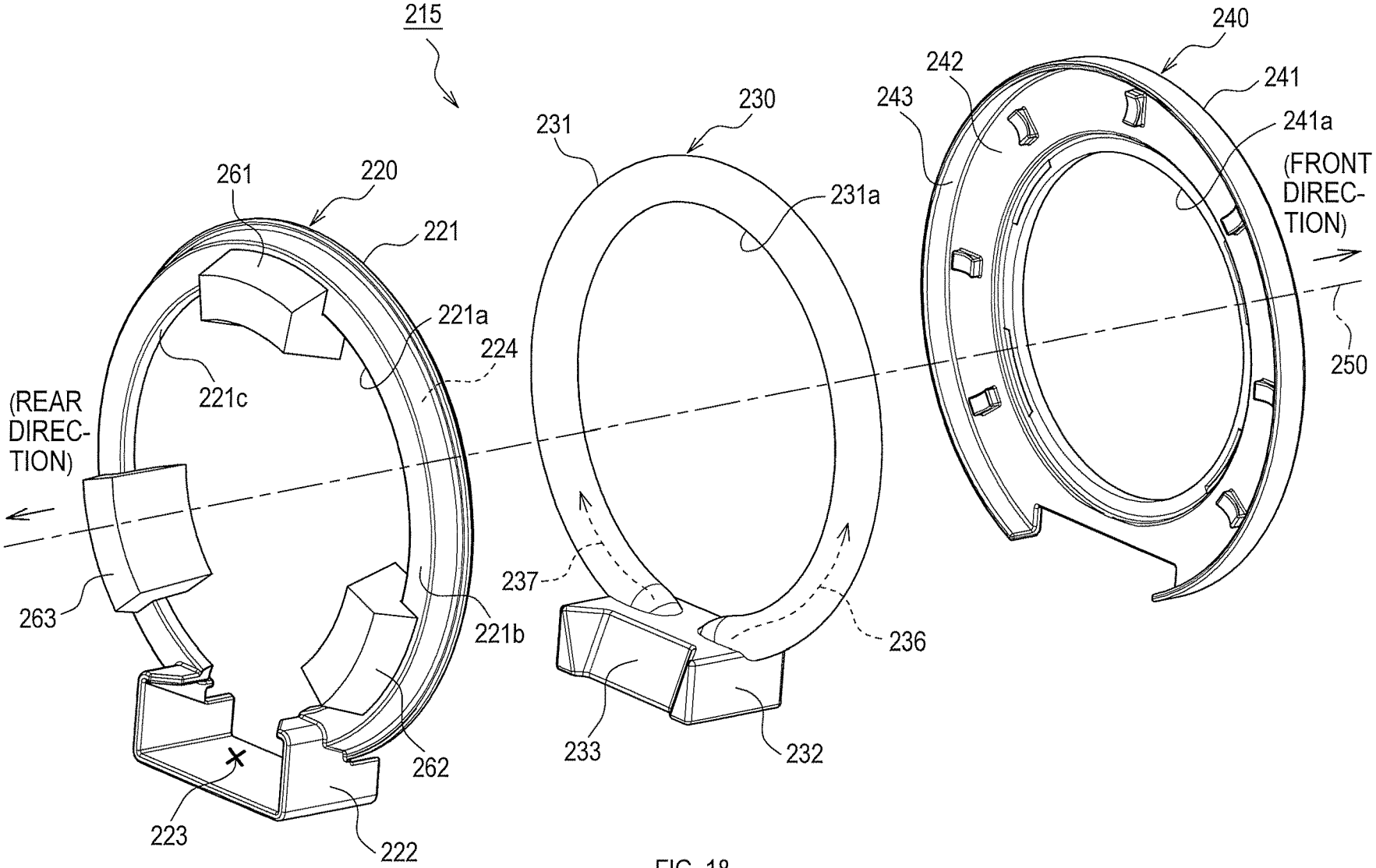
FIG. 18 is an exploded perspective view of the illuminator attachment.

As shown in FIG. 17 and FIG. 18, the illuminator attachment 215 includes a light guide 230. The illuminator attachment 215 further includes a reflector 220. The illuminator attachment 215 further includes a cover 240. In FIG. 18, a reference numeral 250 indicates a center axis. The center axis 250 corresponds to the center axis 150 in the first embodiment.

The light guide 230, the reflector 220 and the cover 240 each have, for example, a ring-shape. More specifically, in the second embodiment, the light guide 230, the reflector 220 and the cover 240 each have, for example, a circular ring-shape. The reflector 220 is arranged behind the light guide 230. The cover 240 is arranged in front of the light guide 230. The cover 240 is attached to the reflector 220 so as to cover the light guide 230.

The reflector 220 includes a reflecting member 221 and a third storage 222. The reflector 220 includes the first to third supports 261 to 263 formed thereon.

The reflecting member 221 includes a reflector opening 221*a*. The reflecting member 221 has a ring-shape, for example. The reflecting member 221 further includes a back surface 221*b* and an inner circumference surface 221*c*. The back surface 221*b* corresponds to a back side surface of the reflecting member 221. Each of the first to third supports 261 to 263 may be attached to the reflector 220 by any method. In the second embodiment, each of the first to third supports 261 to 263 is for example, adhered to the back surface 221*b* and the inner circumference surface 221*c*.

The reflecting member 221 further includes a groove 224. The groove 224 corresponds to a surface on a front side of the reflecting member 221. The groove 224 is formed to be similar to the groove 46 of the first embodiment. The groove 224 functions similarly to the groove 46 of the first embodiment. That is, the groove 224 is annularly formed along the circumferential direction of the reflecting member 221. In the groove 224, a light guide member 231 of the light guide 230 is fitted. The light guide 230 is attached to the reflector 220 so that a roughly entire portion of the light guide 230 faces the reflecting member 221.

Figure 19:
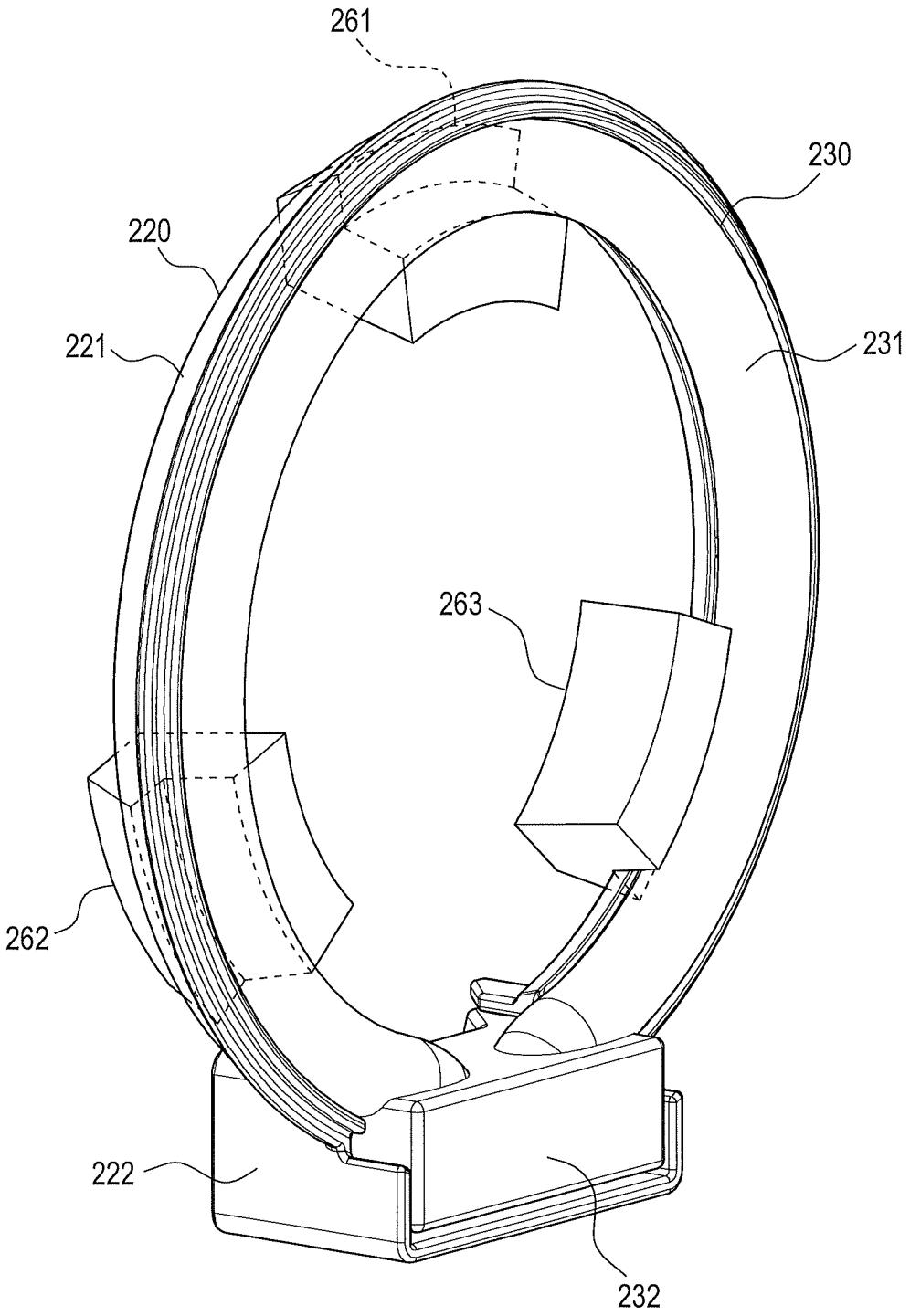
FIG. 19 is a front perspective view of the illuminator attachment, with a cover removed.

The light guide 230 includes a light guide member 231. The light guide member 231 includes a light guide opening 231*a*. The light guide member 231 has a ring-shape, for example. The light guide member 231 is fitted in the groove 224. FIG. 19 shows the illuminator attachment 215 with the cover 240 removed. FIG. 19 shows the light guide 230 fitted in the groove 224.

As shown in FIG. 18, the light guide member 231 has a light entering portion 232 formed thereon. The light entering portion 232 includes a light entering surface 233. In the case where the illuminator attachment 215 is attached to the electric working machine 200, the light emitted from the light emitter 211 enters the light entering surface 233.

The light guide member 231 allows the light entered the light entering surface 233 to propagate in a first circumferential direction 236 and a second circumferential direction 237 of the light guide member 231. In other words, the light entered the light entering surface 233 is separated into two directions at the light entering portion 232 and propagates inside the light guide member 231. While being reflected and propagating inside the light guide member 231, the light entered the light entering surface 233 is radiated from a roughly entire surface of the light guide member 231. A part or all of the light radiated from the light guide 230 in the rear direction of the electric working machine 200 is reflected by the reflector 220 and guided in the front direction of the electric working machine 200.

The cover 240 includes a cover member 241. The cover member 241 includes a cover opening 241*a*. The cover member 241 has a ring-shape, for example. Specifically, the cover member 241 includes an annular cover surface 242 and a flange 243. The flange 243 is arranged along an outer circumference of the cover surface 242. The cover member 241 has a light transmittance of more than zero. The light radiated from the light guide 230 passes through the cover member 241 and is radiated toward the surrounding area (mainly in the front direction) of the electric working machine 200. The cover 240 may be, for example, attached to the reflector 220 as in the case of the first embodiment.

(2-3) Attachment Process of Illuminator Attachment

One exemplary process of attaching the illuminator attachment 215 to the electric working machine 200 will be described. A user of the electric working machine 200 firstly moves the illuminator attachment 215 closer to the electric working machine 200 (i.e. in the rear direction) from the front of the electric working machine 200, and inserts the opening of the illuminator attachment 215 around the front portion of the electric working machine 200. As described above, the front portion of the first storage 205 has a substantially circular truncated cone shape. Thus, in response to the illuminator attachment 215 moved further in the rear direction, the first to third supporting surfaces 261*a* to 263*a* each come in contact with the tip outer peripheral surface 205*a*.

After the first to third supporting surfaces 261*a* to 263*a* come in contact with the tip outer peripheral surface 205*a*, the illuminator attachment 215 is further moved in the rear direction. Then, the first to third supporting surfaces 261*a* to 263*a* each receive pressure (reaction force) from the tip outer peripheral surface 205*a*. This pressure has a component (i) in a direction orthogonal to the tip outer peripheral surface 205*a*, and (ii) in a direction separated from the electric working machine 200. Thus, the first to third supports 261 to 263 each are elastically deformed toward an outer circumference side (i.e. pressed and deformed in the outer circumference side) of the illuminator attachment 215 due to the pressure received from the tip outer peripheral surface 205*a*. In other words, the first to third supporting surfaces 261*a* to 263*a* each bias the tip outer peripheral surface 205*a*. With the biasing force, the illuminator attachment 215 is attached to (i.e. elastically supported by) the electric working machine 200.

After the first to third supporting surfaces 261*a* to 263*a* come in contact with the tip outer peripheral surface 205*a*, the illuminator attachment 215 is further moved backward to a specified position. This allows the biasing force to become suitable magnitude. The suitable magnitude corresponds to a force allowing the illuminator attachment 215 to be properly held on the electric working machine 200. The illuminator attachment 215 arranged at a specified position is held on the electric working machine 200 to a degree at least preventing a free fall.

In response to the illuminator attachment 215 arranged at the specified position, the light entering surface 233 of the light guide 230 and the illuminator cover 210 face each other with a small interval interposed therebetween, or the light entering surface 233 comes in contact with the illuminator cover 210.

By adding force exceeding a certain magnitude in the front direction to the illuminator attachment 215, which is arranged at the specified position (i.e. attached to the electric working machine 200), the biasing force of the first to third supporting surfaces 261*a* to 263*a* is released. In this way, the illuminator attachment 215 is removed from the electric working machine 200.

(2-4) Effect of Second Embodiment

The above-described the illuminator attachment 215 of the second embodiment also provides the same effects as those obtained by the first LED 16 and the light guide 22 of the first embodiment.

In addition, in the second embodiment, the illuminator attachment 215 is attached to the electric working machine 200 by elastically supported by the electric working machine 200. That is, the illuminator attachment 215 is attached to the electric working machine 200 by the first to third supports 261 to 263 each biasing the tip outer peripheral surface 205*a*. In other words, the illuminator attachment 215 is attached to the electric working machine 200 in a state where the first to third supports 261 to 263 each receive pressure (reaction force) from the tip outer peripheral surface 205*a*.

Thus, the user can easily attach the illuminator attachment 215 to the electric working machine 200 as necessary. Also, the user can easily remove the illuminator attachment 215, which is attached to the electric working machine 200, from the electric working machine 200.

In the second embodiment, the light emitter 211 corresponds to one example of the first light emitter in the present disclosure. The first to third supports 261 to 263 each correspond to one example of a support in the present disclosure. The first to third supporting surfaces 261*a* to 263*a* each correspond to one example of a supporting surface in the present disclosure.

[3. Third Embodiment]

Figure 20:
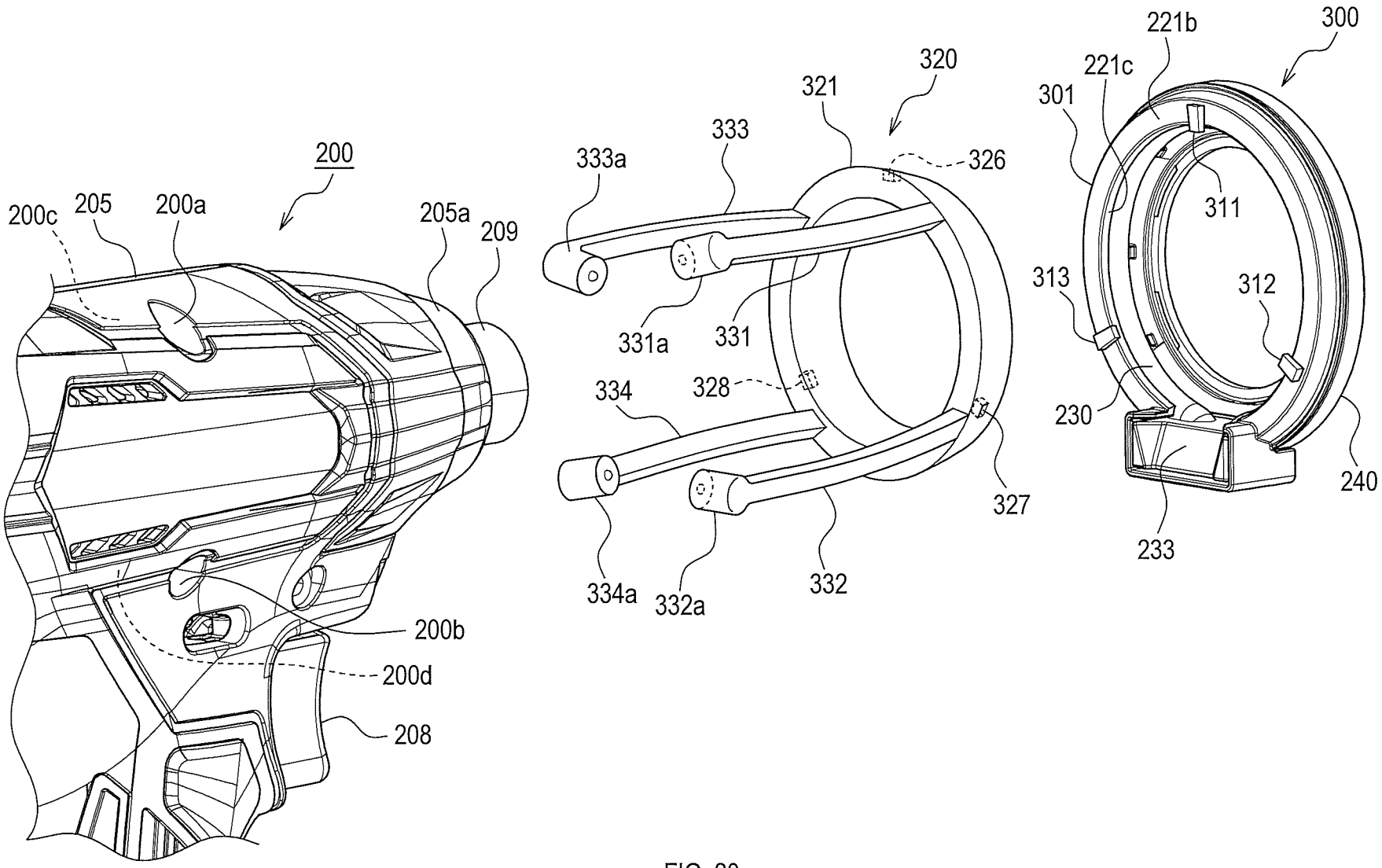
FIG. 20 is a rear perspective view of an electric working machine, an illuminator attachment, and an auxiliary part of a third embodiment.
Figure 21:
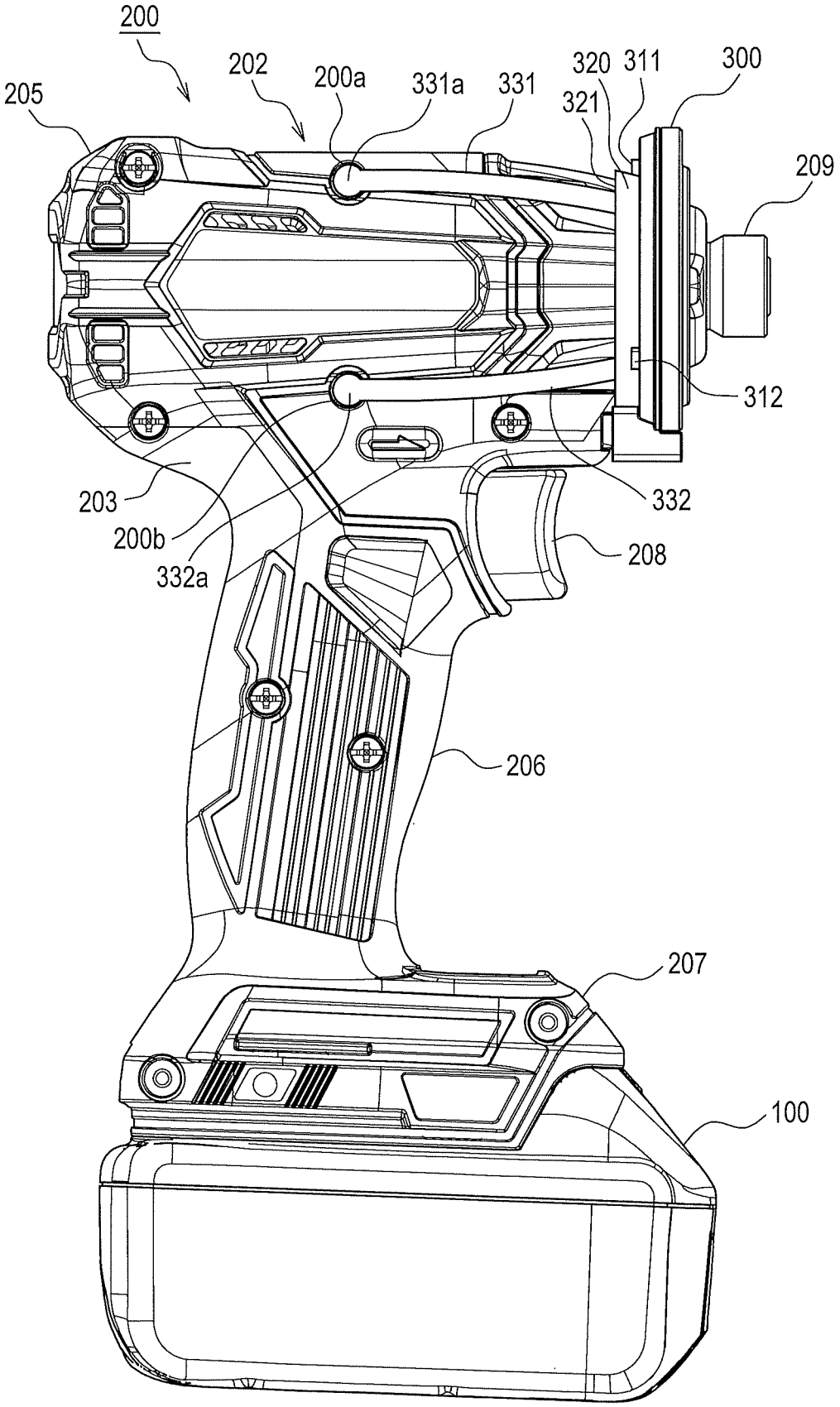
FIG. 21 is a side view of the electric working machine of the third embodiment, with the illuminator attachment attached.

With reference to FIG. 20 and FIG. 21, an illuminator attachment 300 of a third embodiment will be described. The illuminator attachment 300 of the third embodiment is attached to the electric working machine 200 via an auxiliary part 320. In FIG. 20 and FIG. 21, some components identical to those described in the second embodiment are denoted by the same reference numerals used in the second embodiment. The auxiliary part 320 corresponds to one example of an attachment auxiliary part in the present disclosure.

In the electric working machine 200, the main body 202 has two or more holes (side surface holes) on the side surface of the main body 202. In the third embodiment, the electric working machine 200 includes, for example, four side surface holes. Specifically, a first side surface hole 200*a* and a second side surface hole 200*b* are formed on a first side surface of the main body 202. The main body 202 further includes a third side surface hole 200*c* and a fourth side surface hole 200*d* on a second side surface thereof.

The first to fourth side surface holes 200*a* to 200*d* are provided on the electric working machine 200 for the purpose other than the attachment of the illuminator attachment 300. The illuminator attachment 300 of the third embodiment is indirectly attached to the electric working machine 200 by use of these existing first to fourth side surface holes 200*a* to 200*d*.

The illuminator attachment 300 of the third embodiment does not have the first to third supports 261 to 263 as in the case of the illuminator attachment 215 of the second embodiment. The illuminator attachment 300 of the third embodiment has a first protrusion 311, a second protrusion 312 and a third protrusion 313. The first to third protrusions 311 to 313 are each arranged so as to protrude toward a center axis of the illuminator attachment 300 (corresponding to the center axis 250 of the second embodiment). The first to third protrusions 311 to 313 are each configured to be elastically deformed, for example, in a front-rear direction (in other words, configured to be bent in the front-rear direction).

The auxiliary part 320 includes a receiving ring 321 and two or more arms. The two or more arms includes, for example, a first arm 331, a second arm 332, and a third arm 333, and a fourth arm 334.

The receiving ring 321 has a substantially circular truncated cone shape, for example. The receiving ring 321 includes two or more engaging holes. In the third embodiment, the two or more engaging holes include, for example, a first engaging hole 326, a second engaging hole 327 and a third engaging hole 328. The first to third engaging holes 326 to 328 are, for example, arranged at regular intervals with each other along the circumferential direction.

The first to fourth arms 331 to 334 each extend in the rear direction from the receiving ring 321. The first to fourth arms 331 to 334 each have a long bar shape. The first to fourth arms 331 to 334 each have a first end connected to the receiving ring 321.

The first arm 331 has a second end provided with a first auxiliary protrusion 331*a*. The second arm 332 has a second end provided with a second auxiliary protrusion 332*a*. The third arm 333 has a second end provided with a third auxiliary protrusion 333*a*. The fourth arm 334 has a second end provided with a fourth auxiliary protrusion 334*a*.

In the receiving ring 321, the positions of the first to fourth arms 331 to 334 connected to the receiving ring 321, the length of each of the first to fourth arms 331 to 334, and the positions of each of the first to fourth auxiliary protrusions 331*a* to 334*a* may vary depending on the positions of the first to fourth side surface holes 200*a* to 200*d*. That is, the auxiliary part 320 is configured such that in a state of the auxiliary part 320 attached to the electric working machine 200 (FIG. 21), the first auxiliary protrusion 331*a* is fitted in the first side surface hole 200*a*, the second auxiliary protrusion 332*a* is fitted in the second side surface hole 200*b*, the third auxiliary protrusion 333*a* is fitted in the third side surface hole 200*c*, and the fourth auxiliary protrusion 334*a* is fitted in the fourth side surface hole 200*d*.

The first to fourth arms 331 to 334 are each elastically deformable with a specified portion serving as a fulcrum (for example, the first end connected to the receiving ring 321). In a state of the receiving ring 321 inserted around the electric working machine 200 and being in contact with a surface of the electric working machine 200, the first to fourth arms 331 to 334 each bias the surface of the electric working machine 200. The auxiliary part 320 may be made from, for example, a material containing a resin. The auxiliary part 320 may be integrally molded by, for example, injection molding.

Next, a process to attach the illuminator attachment 300 to the electric working machine 200 will be described. A user firstly attaches the auxiliary part 320 to the electric working machine 200. Specifically, the user insert the receiving ring 321 around the front portion of electric working machine 200 from the front direction of the electric working machine 200, whereby the receiving ring 321 comes in contact with the tip outer peripheral surface 205*a* or a portion near the tip outer peripheral surface 205*a*. While inserting the receiving ring 321 around the electric working machine 200, the user may make it easier to insert the receiving ring 321 around the electric working machine 200 by spreading the first to fourth arms 331 to 334 toward an outer circumference side of the auxiliary part 320.

In response to an inner circumference surface of the receiving ring 321 coming in contact with the surface of the electric working machine 200, the first to fourth arms 331 to 334 each bias the surface of the electric working machine 200. Even with this biasing force alone, to some extent, the auxiliary part 320 becomes unlikely to come off from the electric working machine 200. However, in the third embodiment, the auxiliary part 320 is more stably attached to the electric working machine 200 by the user performing the following attachment operation.

Specifically, the user fits the first auxiliary protrusion 331*a* into the first side surface hole 200*a*, the second auxiliary protrusion 332*a* into the second side surface hole 200*b*, the third auxiliary protrusion 333*a* into the third side surface hole 200*c*, and the fourth auxiliary protrusion 334*a* into the fourth side surface hole 200*d*. With this operation, the auxiliary part 320 is stably attached to the electric working machine 200.

In this way, the user attaches the auxiliary part 320 to the electric working machine 200 and then, attaches the illuminator attachment 300 to the auxiliary part 320. Specifically, the user inserts an opening of the illuminator attachment 300 around the tip of the electric working machine 200, and then allows the illuminator attachment 300 to come in contact with the auxiliary part 320. More specifically, tips of the first to third protrusions 311 to 313 come in contact with an outer circumference surface of the receiving ring 321 in the vicinity of the first to third engaging holes 326 to 328. Then, the user fits the first protrusion 311 in the first engaging hole 326 of the auxiliary part 320, the second protrusion 312 in the second engaging hole 327, and the third protrusion 313 in the third engaging hole 328. In this way, the illuminator attachment 300 is attached to the auxiliary part 320. In other words, the illuminator attachment 300 is attached to the electric working machine 200 via the auxiliary part 320.

[4. Other Embodiments]

Although some embodiments of the present disclosure has been described above, the present disclosure is not limited to the above-described embodiments and may be modified in various forms.

(4-1) In the first embodiment, the light guide 22 may be arranged at any position in the main body 2 so that the light from the light guide 22 is radiated in the front direction. For example, the light guide 22 may have a portion housed inside the main body 2.

(4-2) In the first embodiment, the light guide 22, the reflector 21 and/or the cover 23 may have a shape different from the circular ring-shape. The light guide 22, the reflector 21 and/or the cover 23 may have, for example, an elliptical ring-shape or a polygonal ring-shape. The same can be applied to the reflector 220, the light guide 230 and the cover 240 of the second embodiment.

(4-3) In the first embodiment, in the reflector 21, the wiring element group may be installed by any method and at any position. The reflector 21 may be a device different from the MID.

(4-4) In the first embodiment, the second and third LEDs 17, 18 may be arranged at any position. Either one of the second LED 17 or the third LED 18 may be omitted. One or more light emitting parts may be installed in addition to the second and third LEDs 17, 18. Both the second and third LEDs 17, 18 may be omitted.

(4-5) In the second embodiment, the first to third supports 261 to 263 may be arranged at any position in a circumferential direction of the reflector 220. The first to third supports 261 to 263 are not necessarily arranged at regular intervals with each other in the circumferential direction.

The first to third supports 261 to 263 may be arranged on a portion distinct from the reflector 220.

The illuminator attachment 215 may include one, two, four or more supports. The illuminator attachment 215 may include, for example, one support provided with a supporting surface having a substantially circular truncated cone shape. This one support may have, for example, a shape in which the first support 261 is extended in the circumferential direction. That is, the one support may have an approximate ring-shape.

(4-6) In the third embodiment, the first to third protrusions 311 to 313 each may be arranged at any position in the circumferential direction of the reflector 220. The first to third protrusions 311 to 313 are not necessarily arranged at regular intervals with each other in the circumferential direction.

The first to third protrusions 311 to 313 may be provided to a portion different from the reflector 220. The illuminator attachment 300 may include one, two, four or more protrusions.

(4-7) In the third embodiment, the auxiliary part 320 may be attached to the electric working machine 200 by any method. The auxiliary part 320 may be attached to any portion on a side surface of the electric working machine 200. That is, the auxiliary part 320 may be engaged with any portion other than the first to fourth side surface holes 200*a* to 200*d* in the electric working machine 200. The auxiliary part 320 may have any number of the arms. The auxiliary part 320 does not necessarily have the auxiliary protrusion on each arm. For example, at least one of all the arms may have the auxiliary protrusion.

(4-8) In the third embodiment, the illuminator attachment 300 may have a function of the auxiliary part 320. For example, the illuminator attachment 300 may have the first to fourth arms 331 to 334 instead of the first to third protrusions 311 to 313.

(4-9) The first light emitter and/or the second light emitter of the present disclosure are not necessarily limited to LEDs. The first light emitter and/or the second light emitter may include a light source distinct from the LED.

(4-10) The battery 101 may be built in the main body 2. The present disclosure may be applied to an electric working machine powered by power supply different from a battery. For example, the present disclosure may be applied to an electric working machine configured to be powered by a commercial AC current.

(4-11) In the aforementioned embodiment, the rechargeable impact driver has been described as one example of electric working machines. However, the technique of the present disclosure may be applied to other electric working machines configured to work on a target object. The target object may be any object. Example of the target object may include: a workpiece made of, for example, wood, metal, plastic or other materials; fixing materials such as screws, nails, and nuts; plants; dust; gas; and liquid. The electric working machine may include any tool. The tool may work on the target object in any form. For example, the tool may be a drill bit to form a hole in the workpiece. The tool may be a rotating blade to cut the workpiece. The tool may be a grinding wheel to polish the workpiece. The tool may be a rotary wing to flow in and/or flow out gas or liquid.

(4-12) The technique of the present disclosure may be applied to job-site electric apparatuses used in a various job sites, such as do-it-yourself carpentry, manufacturing, gardening, and construction. Specifically, the technique of the present disclosure may be applied, for example, to an electric working machine, such as an electric power tool for masonry work, metalworking, or woodworking, or a working machine for gardening, or an electric apparatus for preparing an environment of a work site. More specifically, the present disclosure may be applied to an electric working machine, such as an electric hammer, an electric hammer drill, an electric drill, an electric driver, an electric wrench, an electric grinder, an electric circular saw, an electric reciprocating saw, an electric jigsaw, an electric cutter, an electric chainsaw, an electric plane, an electric nailer (including an electric tacker), an electric hedge trimmer, an electric lawn mower, an electric lawn trimmer, an electric grass cutter, an electric cleaner, an electric blower, an electric sprayer, an electric spreader, an electric dust collector. In the case where the present disclosure is applied to the electric cleaner, the electric cleaner may include a light guide, for example, so as to surround an inlet to suck the air in.

(4-13) Two or more functions achieved by one element in the aforementioned embodiment may be achieved by two or more elements. A function achieved by one element may be achieved by two or more elements. Two or more functions achieved by two or more elements may be achieved by one element. One function achieved by two or more elements may be achieved by one element. A part of the configuration of the aforementioned embodiment may be omitted. An element of one of the aforementioned embodiments may be added to or replaced with another embodiment or other embodiments of the aforementioned embodiments.

What is claimed is:

1. An electric working machine comprising:

a motor;

a driving mechanism configured to transmit rotational force of the motor to a tool;

a housing accommodating the motor and the driving mechanism therein;

a grip configured to be held by a user of the electric working machine;

a first light emitter configured to emit light;

a light guide (1) having a ring-shape, (2) extending along an outer circumference of the housing, (3) including a light entering surface configured to receive the light emitted from the first light emitter, and (4) being configured such that while propagating the light entering the light entering surface in the light guide, the light guide radiates the light from a surface of the light guide; and a reflector configured to reflect the light radiated in a first direction from the light guide toward a second direction, the second direction being opposite the first direction.

2. The electric working machine according to claim 1, wherein the light guide has a center axis, and wherein the first direction and the second direction intersect with a first virtual plane orthogonal to the center axis.

3. The electric working machine according to claim 1, wherein the reflector includes an annular member having a ring-shape, and wherein the light guide is arranged so as to face the annular member.

4. The electric working machine according to claim 3, wherein the annular member includes a groove arranged along a circumferential direction of the annular member, and wherein the light guide is fitted into the groove.

5. The electric working machine according to claim 4, further comprising a cover having a ring-shape, the cover having a light transmittance of more than zero, the cover being detachably attached to the reflector so as to cover the light guide over a circumferential direction of the light guide.

6. The electric working machine according to claim 1, wherein the first light emitter is provided to the reflector.

7. The electric working machine according to claim 6, wherein the reflector is integrally molded with an insulating material.

8. The electric working machine according to claim 7, wherein the insulating material contains resin.

9. The electric working machine according to claim 7, wherein the reflector includes a first conductor trace integrally provided to a surface of the reflector, the first conductor trace being electrically coupled to the first light emitter.

10. The electric working machine according to claim 7, further comprising a second light emitter provided to the reflector, the second light emitter being configured to emit additional light.

11. The electric working machine according to claim 10, wherein the reflector includes a second conductor trace provided to a surface of the reflector, the second conductor trace being electrically coupled to the second light emitter.

12. The electric working machine according to claim 1 further comprising a second light emitter configured to emit additional light.

13. The electric working machine according to claim 12, wherein an optical axis of the additional light intersects with a center axis of the light guide.

14. The electric working machine according to claim 1, further comprising an engaged portion, wherein the reflector includes an engaging portion configured to be engaged with the engaged portion, and wherein the reflector is detachably attached to the electric working machine by the engaging portion engaged with the engaged portion.

15. The electric working machine according to claim 1, wherein the first light emitter includes a light emitting diode.

16. An electric working machine comprising:

a motor;

a driving mechanism configured to transmit rotational force of the motor to a tool;

a housing accommodating the motor and the driving mechanism therein;

a grip configured to be held by a user of the electric working machine;

a first light emitter configured to emit light, the first light emitter being provided to the housing; and an illuminator attachment including a light guide, the illuminator attachment having a ring-shape and being configured to be detachably attached to the housing, wherein the light guide (1) has a ring-shape, (2) extends along an outer circumference of the housing, (3) includes a light entering surface configured to receive the light emitted from the first light emitter, and (4) is configured such that while propagating the light entering the light entering surface in the light guide, the light guide radiates the light from a surface of the light guide.

17. The electric working machine according to claim 16, wherein the illuminator attachment includes at least one support, wherein the at least one support includes a supporting surface, and wherein the supporting surface is configured to come in contact with a surface of the housing.

18. The electric working machine according to claim 17, wherein the at least one support is configured to be elastically deformed by being pressed from the surface of the housing in response to the illuminator attachment being arranged at a specified position, and wherein the illuminator attachment arranged at the specified position is configured to be attached to the housing by biasing force applied to the surface of the housing from the at least one support elastically deformed.

19. The electric working machine according to claim 17, wherein the at least one support includes two or more supports arranged to be separated from each other along a circumferential direction of the illuminator attachment.

20. An electric working machine comprising:

a motor;

a driving mechanism configured to transmit rotational force of the motor to a tool;

a housing accommodating the motor and the driving mechanism therein;

a grip configured to be held by a user of the electric working machine;

a first light emitter configured to emit light, the first light emitter being provided to the housing:

an attachment auxiliary part configured to be detachably attached to the housing; and an illuminator attachment (1) configured to be detachably attached to the attachment auxiliary part, (2) having a ring-shape, and (3) including a light guide, wherein the light guide (1) has a ring-shape, (2) extends along an outer circumference of the housing, (3) includes a light entering surface configured to receive the light emitted from the first light emitter, and (4) is configured such that while propagating the light entering the light entering surface in the light guide, the light guide radiates the light from a surface of the light guide.

21. An electric working machine comprising:

a motor;

a driving mechanism configured to transmit rotational force of the motor to a tool;

a housing accommodating the motor and the driving mechanism therein;

a grip configured to be held by a user of the electric working machine;

a first light emitter configured to emit light; and a light guide (1) having a ring-shape, (2) extending along an outer circumference of the housing, (3) including a light entering surface configured to receive the light emitted from the first light emitter, (4) being configured such that while propagating the light entering the light entering surface in the light guide, the light guide radiates the light from a surface of the light guide, and (5)

having a center axis, wherein a plane including the light entering surface intersects the center axis.

22. The electric working machine according to claim 21, wherein the plane is orthogonal to the center axis.

23. An electric working machine comprising:

a motor;

a driving mechanism configured to transmit rotational force of the motor to a tool;

a housing accommodating the motor and the driving mechanism therein;

a grip configured to be held by a user of the electric working machine;

a first light emitter configured to emit light; and a light guide (1) having a ring-shape, (2) extending along an outer circumference of the housing, (3) including a light entering surface configured to receive the light emitted from the first light emitter, (4) being configured such that while propagating the light entering the light entering surface in the light guide, the light guide radiates the light from a surface of the light guide, and (5)

being configured to propagate the light entering the light entering surface from the first light emitter in a first circumferential direction of the light guide and in a second circumferential direction of the light guide, the second circumferential direction being opposite the first circumferential direction.

24. An illuminator attachment comprising:

a support configured to detachably support the illuminator attachment on an electric working machine, the electric working machine including a motor, a housing, a grip and a light emitter;

a light guide (1) having a ring-shape, (2) being configured to surround an outer circumference of the housing in response to the illuminator attachment being attached to the electric working machine, (3) including a light entering surface, the light entering surface being configured to receive light emitted from the light emitter, and (4) being configured such that while propagating the light entering the light entering surface in the light guide from the light emitter, the light guide radiates the light from a surface of the light guide; and a reflector configured to reflect the light radiated in a first direction from the light guide toward a second direction, the second direction being opposite the first direction.

25. A method of radiating light from an electric working machine, the method comprising:

emitting light from a light emitter provided to the electric working machine;

receiving the light emitted from the light emitter into a light guide, the light guide having a ring-shape;

propagating the light received into the light guide from the light emitter in the light guide along a circumferential direction of the light guide;

radiating the light propagating in the light guide from a surface of the light guide; and reflecting the light radiated in a first direction from the light guide toward a second direction, the second direction being opposite the first direction.

26. An illuminator attachment comprising:

a support configured to detachably support the illuminator attachment on an electric working machine, the electric working machine including a motor, a housing, a grip and a light emitter; and a light guide (1) having a ring-shape, (2) being configured to surround an outer circumference of the housing in response to the illuminator attachment being attached to the electric working machine, (3) including a light entering surface, the light entering surface being configured to receive light emitted from the light emitter, (4) being configured such that while propagating the light entering the light entering surface in the light guide, the light guide radiates the light from a surface of the light guide, and (5) having a center axis, wherein a plane including the light entering surface intersects the center axis.

27. An illuminator attachment comprising:

a support configured to detachably support the illuminator attachment on an electric working machine, the electric working machine including a motor, a housing, a grip and a light emitter; and a light guide (1) having a ring-shape, (2) being configured to surround an outer circumference of the housing in response to the illuminator attachment being attached to the electric working machine, (3) including a light entering surface, the light entering surface being configured to receive light emitted from the light emitter, (4) being configured such that while propagating the light entering the light entering surface from the light emitter in the light guide, the light guide radiates the light from a surface of the light guide, and (5) being configured to propagate the light entering the light entering surface in a first circumferential direction of the light guide and in a second circumferential direction of the light guide, the second circumferential direction being opposite the first circumferential direction.

28. A method of radiating light from an electric working machine, the method comprising:

emitting light from a light emitter provided to the electric working machine;

receiving the light emitted from the light emitter into a light guide, the light guide (1) having a ring-shape, (2) including a light entering surface, the light entering the light entering surface, and (3) having a center axis, wherein a plane including the light entering surface intersects the center axis;

propagating the light received into the light guide in the light guide along a circumferential direction of the light guide; and radiating the light propagating in the light guide from a surface of the light guide.

29. A method of radiating light from an electric working machine, the method comprising:

emitting light from a light emitter provided to the electric working machine;

receiving the light emitted from the light emitter through a light entering surface of a light guide, the light guide having a ring-shape;

propagating the light entering the light entering surface from the light emitter in the light guide in a first circumferential direction of the light guide and in a second circumferential direction of the light guide, the second circumferential direction being opposite the first circumferential direction; and radiating the light propagating in the light guide from a surface of the light guide.

* * * * *